US009274445B2

(12) United States Patent
Awamura et al.

(10) Patent No.: US 9,274,445 B2
(45) Date of Patent: Mar. 1, 2016

(54) TONER SET, DEVELOPER SET, AND IMAGE FORMING APPARATUS

(71) Applicants: Junichi Awamura, Shizuoka (JP); Teruki Kusahara, Shizuoka (JP); Satoshi Ogawa, Nara (JP); Daisuke Ito, Kanagawa (JP); Daisuke Inoue, Shizuoka (JP); Osamu Uchinokura, Shizuoka (JP); Satoshi Kojima, Shizuoka (JP); Tsuneyasu Nagatomo, Shizuoka (JP); Mamoru Hozumi, Miyagi (JP); Syouko Satoh, Miyagi (JP)

(72) Inventors: Junichi Awamura, Shizuoka (JP); Teruki Kusahara, Shizuoka (JP); Satoshi Ogawa, Nara (JP); Daisuke Ito, Kanagawa (JP); Daisuke Inoue, Shizuoka (JP); Osamu Uchinokura, Shizuoka (JP); Satoshi Kojima, Shizuoka (JP); Tsuneyasu Nagatomo, Shizuoka (JP); Mamoru Hozumi, Miyagi (JP); Syouko Satoh, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/800,099

(22) Filed: Mar. 13, 2013

(65) Prior Publication Data

US 2013/0244158 A1 Sep. 19, 2013

(30) Foreign Application Priority Data

Mar. 14, 2012 (JP) ..... 2012-057556

(51) Int. Cl.

| | |
|---|---|
| ***G03G 9/00*** | (2006.01) |
| ***G03G 9/08*** | (2006.01) |
| ***G03G 9/087*** | (2006.01) |

(52) U.S. Cl.

CPC ..... *G03G 9/0819* (2013.01); *G03G 9/0804* (2013.01); *G03G 9/0821* (2013.01); *G03G 9/08782* (2013.01); *G03G 9/08795* (2013.01); *G03G 9/08797* (2013.01)

(58) Field of Classification Search

CPC ..... G03G 9/0819; G03G 9/08755; G03G 9/08795; G03G 9/08797

USPC ..... 430/105, 109.1, 137.17, 107.1

See application file for complete search history.

(56) References Cited

U.S. PATENT DOCUMENTS

| | | | | |
|---|---|---|---|---|
| 6,821,698 | B2 * | 11/2004 | Sawada et al. | 430/108.4 |
| 2004/0137356 | A1 * | 7/2004 | Tomita et al. | 430/124 |
| 2010/0183966 | A1 * | 7/2010 | Kadokura et al. | 430/107.1 |
| 2010/0310980 | A1 * | 12/2010 | Sugimoto et al. | 430/108.2 |
| 2011/0076607 | A1 | 3/2011 | Sugimoto et al. | |
| 2011/0081608 | A1 | 4/2011 | Yaguchi et al. | |
| 2011/0151372 | A1 | 6/2011 | Watanabe et al. | |

(Continued)

FOREIGN PATENT DOCUMENTS

| | | |
|---|---|---|
| JP | 04-278967 | 10/1992 |
| JP | 04-338984 | 11/1992 |

(Continued)

*Primary Examiner* — Thorl Chea

(74) *Attorney, Agent, or Firm* — Oblon, McClelland, Maier & Neustadt, L.L.P.

(57) ABSTRACT

A toner set, including: a transparent toner including a binder resin a, a releasing agent a and no colorant; and one or more color toners, each including a binder resin b, a colorant b and a releasing agent b, wherein the binder resin a includes a non-crystalline resin α and a crystalline resin α, the binder resin b includes a non-crystalline resin β and a crystalline resin β, the releasing agent a has an average particle diameter as a long diameter of 0.2 μm to 2.0 μm, and there is a relationship of $1<A/B<1.5$, where A is an area of the releasing agent a in a transparent toner cross-section from a surface thereof to a ⅓-depth of a volume-average particle diameter, and B is an area of the releasing agent b in a color-toner cross-section from a surface thereof to a ⅓-depth of a volume-average particle diameter.

7 Claims, 3 Drawing Sheets

(56) References Cited

U.S. PATENT DOCUMENTS

| | | | |
|---|---|---|---|
| 2011/0200928 | A1 | 8/2011 | Watanabe et al. |
| 2011/0200929 | A1 | 8/2011 | Karato et al. |
| 2011/0223532 | A1 | 9/2011 | Sugimoto et al. |
| 2011/0262853 | A1 | 10/2011 | Watanabe et al. |
| 2011/0294058 | A1 | 12/2011 | Shiba et al. |
| 2011/0305986 | A1 | 12/2011 | Ogawa et al. |
| 2012/0021347 | A1 | 1/2012 | Shimota et al. |
| 2012/0052431 | A1 | 3/2012 | Hozumi et al. |
| 2012/0052434 | A1 | 3/2012 | Sugimoto et al. |
| 2012/0064447 | A1 | 3/2012 | Hozumi et al. |
| 2012/0122027 | A1 | 5/2012 | Watanabe et al. |
| 2012/0219896 | A1 | 8/2012 | Asahina et al. |
| 2012/0237869 | A1 | 9/2012 | Chiba et al. |
| 2012/0237870 | A1 | 9/2012 | Watanabe et al. |
| 2012/0264043 | A1 | 10/2012 | Watanabe et al. |

FOREIGN PATENT DOCUMENTS

| | | |
|---|---|---|
| JP | 08-220821 | 8/1996 |
| JP | 2004-206081 | 7/2004 |
| JP | 2009-109926 | 5/2009 |
| JP | 2009-134060 | 6/2009 |
| JP | 2011-100106 | 5/2011 |
| JP | 2011-186295 | 9/2011 |

* cited by examiner

TONER SET, DEVELOPER SET, AND IMAGE FORMING APPARATUS

BACKGROUND OF THE INVENTION

1. Field of the Invention

The present invention relates to a toner set, a developer set, and an image forming apparatus.

2. Description of the Related Art

For an electrophotographic image forming apparatus of recent years, there have been increasing demands for saving of energy during toner fixing and for an image forming apparatus capable of high-speed processing, and a toner itself is required to have a property to melt at a low temperature. There are also large demands for high-quality image, and for a demand of high-definition image formation such as photographic image, it has been known that a vivid high-gloss image may be provided by imparting gloss on a surface of a recording medium such as recording paper.

For example, a method of disposing a transparent toner in a non-image area without a color toner is disclosed (see Japanese Patent Application Laid Open (JP-A) No. 04-278967). In this method, in electrophotography used in an image forming apparatus such as recording laser printer, dry electrostatic copier and so on, a surface of the image bearing member such as photoconductive layer is uniformly charged. Subsequently, the surface of the image bearing member is exposed, and gloss differences between an area with a color toner and an area without a color toner of exposed areas on a medium, or a transparent toner is disposed on a whole surface of a recording medium.

However, a method for manufacturing the toner includes a step for polymerizing by polyaddition reaction of a polyester prepolymer having an isocyanate group with an amine in a reaction system in which an organic solvent and an aqueous medium co-exist. In a case of this method and a toner obtained by this method, high temperature-resistant offset property improves, but there are problems of inhibiting low-temperature fixing property and reducing gloss after fixing.

Also, a method first to print and fix a gloss area and second to print and fix a non-gloss area is proposed (see JP-A No. 04-338984). It is possible to obtain different glosses on an identical recording medium according to these methods.

In this method, to improve low-temperature fixing property, crystalline polyester is introduced to a toner obtained by a polymerization method. However, a dispersion having a small particle diameter may not be obtained in a stable manner, and as a result, there is a problem that toner particle size distribution degrades.

Also, as an electrophotographic method for forming different glosses on an identical recording medium, a method to control gloss by a number-average molecular weight of a resin used for a toner is proposed (see JP-A No. 08-220821). In this method, a polyester resin having a number-average molecular weight of about 3,500 is used as a transparent toner, and a polyester resin having a number-average molecular weight of about 10,000 is used as a color toner. Because of the transparent toner having a melting point lower than the color toner, smoothness increases, and glossiness of a portion of the transparent toner becomes partially high.

However, the transparent toner is formed at a top of an image, and it contacts directly with a fixing machine. Thus, it is required to have higher hot-offset resistance than the color toner. At the same time, since the transparent toner is formed on a color-toner image, a toner layer becomes thick. There is a problem that color toner lacks stability unless it has high cold offset property.

Also, a method of forming a transparent toner image after fixing a color toner and reducing a fixing temperature so as to decrease gloss is proposed (see JP-A No. 2009-109926). However, in this method, a melt viscosity of the toner reached in a fixing nip during second image formation is configured higher than that in the fixing nip during a first image formation. Therefore, there is a problem that gloss falls because the transparent toner image prepared during the second image formation does not sufficiently melt.

SUMMARY OF THE INVENTION

The present invention aims at solving the above problems in the conventional technologies and at achieving the following objection. That is, the present invention aims at providing a toner set which has superior low-temperature fixing property and further which may form a high-gloss portion partially on an identical recording medium.

Means for solving the problems are as follows. That is,

A toner set of the present invention is a toner set, including:

a transparent toner which includes a binder resin a and a releasing agent a and which does not include a colorant; and one or more color toners, each of which includes a binder resin b, a colorant b and a releasing agent b, wherein the binder resin a includes a non-crystalline resin $\alpha$ and a crystalline resin $\alpha$, wherein the binder resin b includes a non-crystalline resin $\beta$ and a crystalline resin $\beta$, wherein the releasing agent a has an average particle diameter as a long diameter of 0.2 μm to 2.0 μm, and wherein the toner set has a relationship of $1<A/B<1.5$, where A is defined as an area of the releasing agent a in a cross-section of the transparent toner existing in a region from a surface of the transparent toner to a depth of ⅓ of a volume-average particle diameter of the transparent toner, and B is defined as an area of the releasing agent b in a cross-section of the color toner existing in a region from a surface of the color toner to a depth of ⅓ of a volume-average particle diameter of the color toner.

The present invention may solved the conventional problems and achieve the objectives above, and it may provide a toner set which has superior low-temperature fixing property and further which may form a high-gloss portion partially on an identical recording medium.

DETAILED DESCRIPTION OF THE INVENTION

Figure 1:
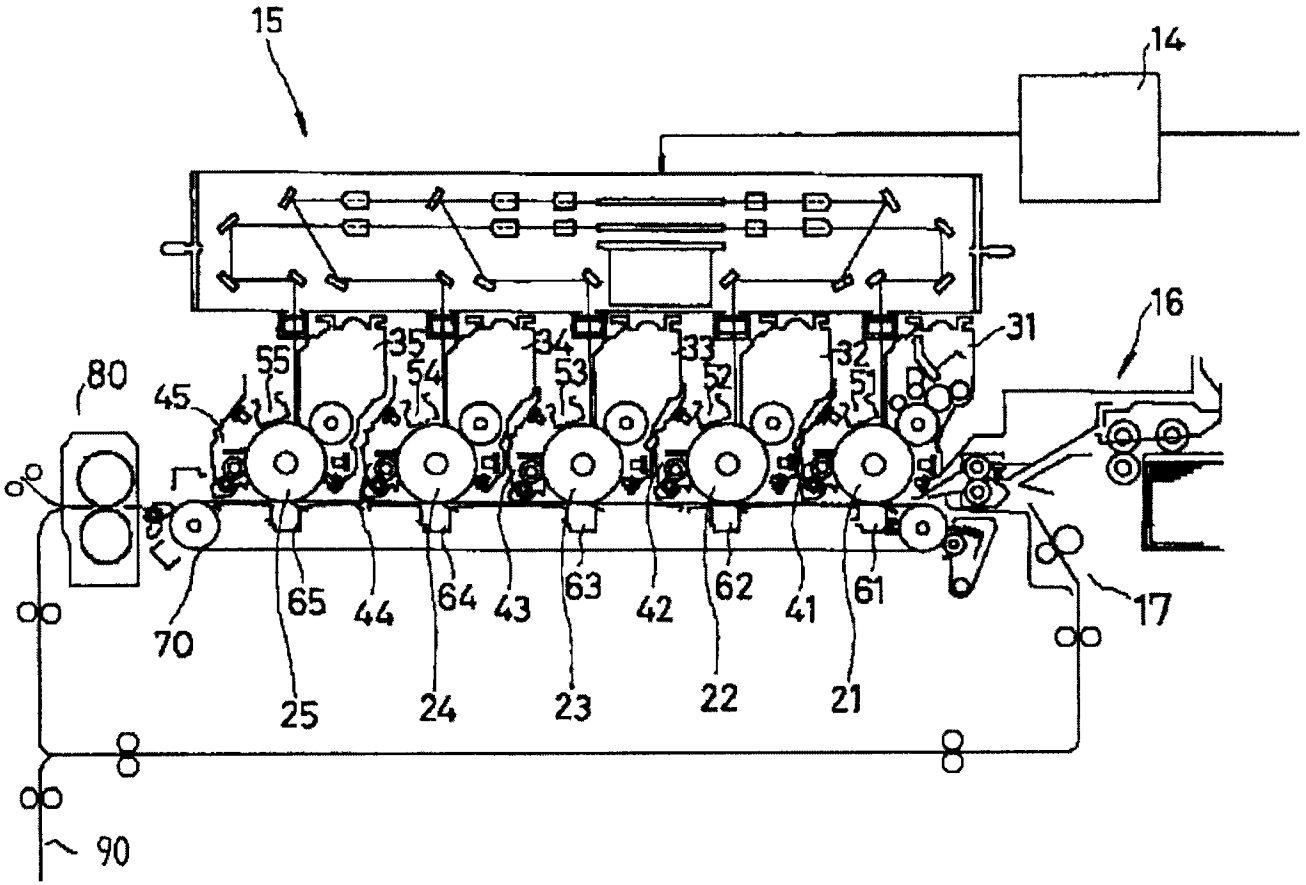
FIG. 1 is a diagram illustrating an overview of one example of an image forming apparatus.

Hereinafter, embodiments of the present invention are explained. The embodiments shall not be construed as limiting the scope of the present invention.

(Toner Set)

A toner set of the present invention is a toner set including: a transparent toner which includes a binder resin and a releasing agent and does not include a colorant; and one or more color toners which includes a binder resin, a colorant and a releasing agent. Hereinafter, the binder resin and the releasing agent in the transparent toner may also be referred to as a "binder resin a" and a "releasing agent a", respectively. Also, the binder resin, the colorant and the releasing agent in the color toner may also be referred to as a "binder resin b", a "colorant b" and a "releasing agent b".

An image may be formed on a recording medium with the one or more color toner and the transparent toner which does not include a colorant.

The binder resin a includes a non-crystalline resin and a crystalline resin (hereinafter, they may also be referred to as a "non-crystalline resin α" and a "crystalline resin α", respectively), and the binder resin b includes a non-crystalline resin and a crystalline resin (hereinafter, they may also be referred to as a "non-crystalline resin β" and a "crystalline resin β"). That is, both the color toner and the transparent toner include a crystalline resin.

The releasing agent a in the transparent toner has an average particle diameter as a long diameter of 0.2 μm to 2.0 μm.

Further, when A is defined as an area of the releasing agent a in a cross-section of the transparent toner existing in a region from a surface of the transparent toner to a depth of ⅓ of a volume-average particle diameter of the transparent toner and B is defined as an area of the releasing agent b in a cross-section of the color toner existing in a region from a surface of the color toner to a depth of ⅓ of a volume-average particle diameter of the color toner, there is a relationship of $1<A/B<1.5$.

The crystalline resin α preferably exists in the non-crystalline resin α in a form of a domain, and the crystalline resin α in the transparent toner has an average particle diameter as a long diameter of preferably 0.1 μm to 2.0 μm.

The crystalline resin β preferably exists in the non-crystalline resin β in a form of a domain, and the crystalline resin β in the color toner has an average particle diameter as a long diameter of preferably 0.1 μm to 2.0 μm.

Both the non-crystalline resin α and the crystalline resin α in binder resin a of the transparent toner are preferably a polyester resin.

The transparent toner is required to have high hot-offset resistance since it is located at a top of an image. In the present invention, releasing property with a fixing member is improved by incorporating a releasing agent a in the transparent toner. In order to improve releasing property, it is desirable to increase an amount of the releasing agent existing near an internal surface of the transparent toner. Here, "near an internal surface of a toner" is a region from a surface of the toner to a depth of ⅓ of a volume-average particle diameter of the toner.

As described above, there is a relationship of $1<A/B<1.5$, where A is defined as an area of the releasing agent a near an internal surface of the transparent toner, and B is defined as an area of the releasing agent b existing near an internal surface of the color toner. When the ratio A/B is 1 or less, a releasing effect of the transparent toner is small, a fixing-and-releasing width does not reach a target value. To the contrary, when the ratio A/B is 1.5 or greater, spent toner or filming occurs.

The ratio A/B is calculated based on areas calculated from cross-sectional TEM images of the stained toners. That is, the A and the B are areas calculated from cross-sectional TEM images of the stained toners.

Specifically, the A and the B may be measured, for example, by the following procedure.

First, a toner is sliced by an ultramicrotome (ULTRACUT-S, manufactured by Leica Microsystems Ltd.) to prepare a slice of the toner, which is stained and observed under a transmission electron microscopy (TEM). Then, from a cross-sectional image of the toner obtained, the A or B may be obtained by calculating an area of the releasing agent (per one toner cross-sectional image) existing near the internal surface of the toner (i.e., the region from the surface of the toner to the depth of ⅓ of toner cross-sectional image the volume-average particle diameter of the toner). Also, for measuring the depth from the surface of the toner, particle size distribution measurement software by image analysis (MAC-VIEW, manufactured by Mountech Co., Ltd.) may be used, for example.

Among the toner cross-sectional images obtained, as a cross-sectional image which passes near a center of gravity of the toner, the area is obtained by selecting a toner cross-sectional image having a diameter within ±10% of the volume-average particle diameter of the toner, and thereby, the depth from the surface of the toner may be accurately measured. Also, in the present invention, an average of the areas of 100 toner cross-sectional images is used for calculating each of the A and the B.

As a method to confirm that the crystalline resin exists in the non-crystalline resin in a form of domain, for example, a toner slice is prepared, a cross-section thereof is stained with a heavy metal, and observing under Transmission Electron Microscope (TEM) a contrast due to ease of staining of the resin and observing under Atomic Force Microscope (AFM) a contrast due to difference in hardness of the resin.

An average particle diameter of the crystalline resin is calculated by averaging 100 long diameter values of the crystalline resin in a form of a domain from cross-sectional image of the toner by a TEM image.

<Transparent Toner>

The transparent toner includes at least the binder resin a and the releasing agent a and does not include a colorant, and it further includes other components according to necessity.

<<Binder Resin>>

The binder resin a includes the non-crystalline resin α and the crystalline resin α, and it further includes other binder resins according to necessity.

—Crystalline Resin α—

The crystalline resin α is not particularly restricted, and it may be appropriately selected from conventionally well-known ones according to purpose. Favorable examples thereof include a crystalline polyester resin.

The crystalline polyester resin is not particularly restricted and may be appropriately selected according to purpose. Examples thereof include a crystalline polyester resin having a structure represented by General Formula (1) below, which is synthesized by using: diol compounds having 2 to 6 carbon atoms, especially those including 80% by mole or greater, preferably 85% by mole to 100% by mole, of 1,4-butanediol, 1,6-hexanediol and derivatives thereof as an alcohol component; and at least fumaric acid or a carboxylic acid having a double bond (C=C bond), and derivatives thereof as an acid component.

$$[—O—CO—(CR_1=CR_2)_lCO—O—(CH_2)_n—]_m \quad (1)$$

(where n and m are numbers of repeating units; 1 is an integer of 1 to 3; R1 and R2 are a hydrogen atom or a hydrocarbon group, respectively, and these may be identical or different.)

Also, as a method for controlling crystallinity and a softening point of the crystalline resin α, there is a method of designing and using non-linear polyester obtained by condensation polymerization by adding a polyhydric alcohol having 3 or more valences such as glycerin as an alcohol component and a polycarboxylic acid having 3 or more valences such as trimellitic anhydride as an acid component during polyester synthesis.

A molecular structure of the crystalline polyester resin may be confirmed by, in addition to a liquid- or solid-state NMR measurement, an X-ray diffraction, GC/MS, LC/MS, an IR measurement and so on. Convenient examples include those having absorption at 965±10 $cm^{-1}$ or 90±10 $cm^{-1}$ based on δCH (out-of-plane bending vibration) of olefins in an infrared absorption spectrum.

Regarding a molecular weight of the crystalline resin α (preferably, the crystalline polyester resin), as a result of extensive studies from a viewpoint that those having a sharp molecular-weight distribution and a low molecular weight have superior low-temperature fixing property, it is preferable that a peak is located in a range of 3.5 to 4.0 in a molecular-weight distribution diagram with a horizontal axis expressed in log(M) and a vertical axis expressed in % by mass as a molecular-weight distribution by aGPC (Gel Permeation Chromatography) of an ortho-dichlorobenzene soluble component, that the peak has a half width of 1.5 or less, that a weight-average molecular weight (Mw) is 1,000 to 30,000, that a number-average molecular weight (Mn) is 500 to 6,000, and that Mw/Mn is 2 to 10.

A melting temperature and an $F_{1/2}$ temperature (a melting temperature by a ½ method; see JP-A No. 2009-104193) of the crystalline resin α is desirably low within a range that heat-resistant storage stability does not degrade, and preferably, a DSC endothermic peak temperature is 50° C. to 130° C. When the DSC endothermic peak temperature is less than 50° C., heat-resistant storage stability degrades, and blocking is likely to occur at an internal temperature of a developing apparatus. When it exceeds 130° C., it becomes difficult to obtain low-temperature fixing property due to increased fixing minimum temperature.

Regarding an acid value of the crystalline resin α (preferably, the crystalline polyester resin), in view of compatibility between paper and the resins, in order to achieve the objective low-temperature fixing property, the acid value is preferably 5 mgKOH/g or greater, and more preferably 10 mgKOH/g or greater. On the other hand, it is preferably 45 mgKOH/g or less in order to improve hot offset property. Further, regarding a hydroxyl value of the crystalline polymer, in order to achieve a predetermined low-temperature fixing property and favorable charge properties, the hydroxyl value is preferably 0 mgKOH/g to 50 mgKOH/g, and more preferably 5 mgKOH/g to 50 mgKOH/g.

It is preferable that an endothermic peak temperature (T2–cp) of the crystalline resin α (preferably, the crystalline polyester resin) in the transparent toner calculated from the DSC second temperature increase is 60° C. or greater and less than 80° C. and that the endothermic peak temperature (T2–cp) satisfies the following relationships.

Also, (T2–cs2)–(T2–cp)<10, and (T2–cp)–(T2–cs1)<10. Accordingly, it is preferable (T2–cs2)–10<(T2–cp)<(T2–cs1)+10.

It is preferable that the crystalline resin β in the color toner also satisfies these relationships.

Here, "T2–cs1" is an endothermic shoulder temperature 1 at a low-temperature side of the endothermic peak temperature (T2–cp) calculated from the DSC second temperature increase, and "T2–cs2" is an endothermic shoulder temperature 2 at a high-temperature side of the endothermic peak temperature (T2–cp) calculated from the DSC second temperature increase.

The crystalline resin α demonstrates hot-melt property that it has a rapid viscosity decrease near an endothermic peak temperature (DSC measurement) due to its crystallinity. That is, it has favorable heat resistant storage stability due to crystallinity just before a melt-starting temperature, and it fixes due to a rapid viscosity decrease at the melt-starting temperature (sharp-melt property). Thus, it is possible to design a toner having favorable heat-resistant storage stability and low-temperature fixing property.

By using a resin having a sharp endothermic curve and having an endothermic peak in a range of 60° C. to 80° C. as the crystalline resin α (preferably, the crystalline polyester resin), it becomes possible to satisfy both low-temperature fixing property and heat-resistant storage stability of the toner at the same time. Further, with the crystalline polyester having an endothermic peak temperature of 65° C. to 75° C., it is possible to improve low-temperature fixing property and heat-resistant storage stability of the toner.

Also, because reducing a difference between the endothermic shoulder temperature 1 or 2 and the endothermic peak results in smaller variation in composition and molecular weight in the crystalline polyester molecules, it becomes likely that the viscosity of the crystalline polyester decreases quickly at a temperature near the endothermic peak. Accordingly, it is possible to improve low-temperature fixing property of the toner.

Also, with a difference between the endothermic peak and the endothermic shoulder temperature 1 of less than 10° C., components having low thermal properties in the crystalline polyester may be reduced, and heat-resistant storage stability and blocking resistance may be improved. Further, with the difference of less than 6° C., heat-resistant storage stability and blocking resistance may further be improved.

Also, with a difference between the endothermic peak and the endothermic shoulder temperature 2 of less than 10° C., components having high thermal properties in the crystalline polyester may be reduced, and low-temperature fixing property may be improved. Further, with the difference between the endothermic peak and the endothermic shoulder temperature 2 of less than 6° C., low-temperature fixing property may further be improved.

The crystalline resin α (preferably, the crystalline polyester resin) has a glass transition temperature of preferably 40° C. to 70° C. When the glass transition temperature is less than 40° C., heat-resistant storage stability may decrease. When it exceeds 70° C., low-temperature fixing property may decrease. The crystalline resin α indicates hot-melt property of rapid viscosity decrease near a fixing-starting temperature because of its crystallinity. That is, it has favorable heat-resistant storage stability due to crystallinity just before a melt-starting temperature, and it fixes due to rapid viscosity decrease caused at the melt-starting temperature (sharp-melt property).

Thereby, it is possible to improve low-temperature fixing property of the transparent toner without degrading heat-resistant storage stability. Further, rapid decrease of viscoelasticity of the transparent toner becomes possible. Moreover, it is possible to increase easily image gloss of the transparent toner. By introducing the crystalline resin α, a toner having both favorable heat-resistant storage stability and low-temperature fixing property may be designed. Also, favorable results may be obtained regarding the releasing width (difference between a minimum fixing temperature and hot-offset occurrence temperature).

A content of the crystalline resin α in the transparent toner is preferably 2% by mass to 30% by mass. When the content is less than 2% by mass, it becomes difficult to differentiate it from a color toner image in terms of gloss due to small low-viscosity effect of the transparent toner. Also, when the content exceeds 30% by mass, granulation becomes difficult due to significant viscosity increase in an oil phase during manufacturing the toner.

Also, the content of the crystalline resin α in the transparent toner is preferably greater than the content of the crystalline resin β in the color toner. Thereby, viscoelasticity of the transparent toner may be reduced compared to the color toner.

As a result, gloss difference becomes large when the transparent toner with respect to the color toner image.

Here, when overall high gloss is required, a color toner having a small value of the weight-average molecular weight (Mw)/number-average molecular weight (Mn) may be used. To the contrary, low gloss is required, a color toner having a large value of the weight-average molecular weight (Mw)/number-average molecular weight (Mn) may be used.

When the color toner has low gloss, high gloss may be achieved by thickening a transparent toner layer to cover the asperity by the color toner. Also, by combining a low-gloss color toner and a high-gloss transparent toner and by adjusting a thickness of the transparent toner layer, an image having various gloss from low-gloss to high-gloss may be freely formed.

The transparent toner formed on the color toner preferably has a thickness of the transparent toner layer after fixing of 1 μm to 15 μm. When the thickness is less than 1 μm, it is difficult to increase gloss. The thickness exceeding 15 μm results in reduced fixing strength as well as reduced transparency, which degrades color reproducibility of the color toner.

—Non-Crystalline Resin α—

The non-crystalline resin α is not particularly restricted and may be appropriately selected according to purpose. Examples thereof include a non-crystalline, non-modified resin (e.g. non-modified polyester resin), a non-crystalline, modified resin (e.g. modified polyester resin) and so on.

—Non-Modified Polyester Resin—

A non-crystalline, non-modified polyester resin is preferable as the non-modified resin. It is preferable that the modified polyester resin obtained by elongation and/or crosslinking reaction of a binder resin precursor described hereinafter and the non-modified polyester resin are at least partially compatible. Thereby, low-temperature fixing property and hot-offset resistance may be improved. Thus, polyols and polycarboxylic acids of the modified polyester resin and the non-modified polyester resin preferably have similar compositions. Also, as the non-modified polyester resin, the non-crystalline polyester resin used for the crystalline polyester dispersion may also be used if it is not modified.

The non-modified polyester resin has an acid value of usually 1 KOHmg/g to 50 KOHmg/g, and preferably 5 KOHmg/g to 30 KOHmg/g. Thereby, the acid value is 1 KOHmg/g or greater, and the toner tends to be negatively chargeable. Further, compatibility between paper and the toner improves in fixing on the paper, resulting in improved low-temperature fixing property. However, when the acid value exceeds 50 KOHmg/g, there are cases where charge stability, especially charge stability against environmental variation, decreases. In the present invention, the non-modified polyester resin has an acid value of preferably 1 KOHmg/g to 50 KOHmg/g. The non-modified polyester resin has a hydroxyl value of preferably 5 KOHmg/g or greater.

—Modified Polyester Resin—

—Binder Resin Precursor—

As the binder resin precursor, a binder resin precursor composed of a modified polyester resin is preferable, and examples thereof include polyester prepolymer modified by isocyanate or epoxy groups. This undergoes an elongation reaction with a compound having an active hydrogen group (e.g. amines) and improves a releasing width (difference between minimum fixing temperature and hot-offset occurrence temperature). As a synthetic method of the polyester prepolymer, it may be easily synthesized by reaction a polyester resin as a base with a conventionally heretofore known isocyanating agent or epoxidizing agent. Examples of the isocyanating agent include: aliphatic polyisocyanate (tetramethylene diisocyanate, hexamethylene diisocyanate, 2,6-diisocyanatomethyl caproate and so on); alicyclic polyisocyanate (isophorone diisocyanate, cyclohexyl diisocyanate and so on); aromatic polyisocyanate (tolylene diisocyanate, diphenylmethane diisocyanate and so on); aromatic aliphatic diisocyanate (α,α,α',α'-tetramethylxylylene diisocyanate and so on); isocyanurates; the polyisocyanate blocked by a phenol derivative, oxime, caprolactam and so on; and a combination of two or more thereof. Also, typical examples of the epoxidizing agent include epichlorohydrin and so on.

A ratio of the isocyanating agent, as an equivalent ratio [NCO]/[OH] of an isocyanate group [NCO] to a hydroxyl group [OH] of the polyester as a base, is usually 5/1 to 1/1, preferably 4/1 to 1.2/1, and further preferably 2.5/1 to 1.5/1. When [NCO]/[OH] exceeds 5, low-temperature fixing property degrades. When the molar ratio of [NCO] is less than 1, hot-offset resistance degrades due to a low urea content of this polyester prepolymer.

A content of the isocyanating agent in the polyester prepolymer is usually 0.5% by mass to 40% by mass, preferably 1% by mass to 30% by mass, and further preferably 2% by mass to 20% by mass. The content of less than 0.5% by mass degrades hot-offset resistance and is disadvantageous in terms of having both heat-resistant storage stability and low-temperature fixing property. Also, the content exceeding 40% by mass degrades low-temperature fixing property.

Also, a number of the isocyanate group included per one molecule of this polyester prepolymer is usually 1 or greater, preferably 1.5 to 3 on average, and further preferably 1.8 to 2.5 on average. When it is less than 1 per one molecule, the urea-modified polyester resin after elongation reaction has a small molecular weight, resulting in degraded hot-offset resistance. Also, the binder resin precursor preferably has a weight-average molecular weight of $1\times10^4$ to $3\times10^5$.

Here, other than the non-modified polyester resin, the urea-modified polyester resin may be used in combination with a polyester resin modified by a chemical bond other than an urea bond such as polyester resin modified by a urethane bond.

When a toner composition includes a modified polyester resin such as urea-modified polyester resin, the modified polyester resin may be produced by a one-shot method, for example.

As one example, a method for manufacturing a urea-modified polyester resin is explained.

First, a polyol and a polycarboxylic acid are heated to 150° C. to 280° C. in the presence of a catalyst such as tetrabutoxy titanate, dibutyltin oxide and so on, and removing generated water under a reduced pressure according to necessity, a polyester resin having a hydroxyl group is obtained. Next, the polyester resin having a hydroxyl group and polyisocyanate are reacted at 40° C. to 140° C., and a polyester prepolymer having an isocyanate group is obtained. Further, the polyester prepolymer having an isocyanate group and an amine are reacted at 0° C. to 140° C., and a urea-modified polyester resin is obtained.

The urea-modified polyester resin has a number-average molecular weight of usually 1,000 to 10,000, and preferably 1,500 to 6,000.

Here, in the case where the polyester resin having a hydroxyl group and polyisocyanate are reacted and in the case where the polyester prepolymer having an isocyanate group and the amine are reacted, a solvent may be used according to necessity.

Examples of the solvent include those inert to the isocyanate group such as: aromatic solvents (toluene, xylene and so on); ketones (acetone, methyl ethyl ketone, methyl isobutyl ketone and so on); esters (ethyl acetate and so on); amides (dimethylformamide, dimethylacetamide and so on); ethers (tetrahydrofuran and so on) and so on.

Here, when the non-modified polyester resin is used in combination, those produced in the same manner as the polyester resin having a hydroxyl group may be mixed in the solution after reaction of the urea-modified polyester resin.

<<Releasing Agent a>>

The releasing agent a is not particularly restricted and may be appropriately selected according to purpose. Examples thereof include: liquid paraffin, microcrystalline wax, natural paraffin, synthetic paraffin, polyolefin wax, petrolatum, and partially oxidized products thereof, aliphatic hydrocarbon-based releasing agents (fluorides and chlorides of aliphatic hydrocarbon-based releasing agents and so on); animal oil such as beef tallow, fish oil, bees wax, lanolin and so on; vegetable oil such as palm oil, soybean oil, rapeseed oil, rice bran wax, carnauba wax, cotton wax, japan wax and so on; mineral waxes such as ozokerite, ceresin and so on; synthetic hydrocarbon waxes such as fischer-tropsch wax, polyethylene wax and so on; synthetic waxes such as esters, ketones, ethers and so on; higher aliphatic alcohol-higher fatty acid-based releasing agents such as montan wax and so on; fatty acid amide; fatty acid bisamide; metal soap-based releasing agents such as zinc stearate, calcium stearate, magnesium stearate, aluminum stearate, zinc oleate, zinc palmitate, magnesium palmitate, zinc myristate, zinc laurate, zinc behenate and so on; fatty acid ester-based releasing agents; polyvinylidene fluoride; and so on.

Further, the following compounds may also be used as a releasing agent: fatty acid amides such as 1,2-hydroxy stearic amide, stearic amide, phthalic anhydride imide, chlorinated hydrocarbons and so on; crystalline polymers having a long-chain alkyl group as a side chain thereof such as homopolymers or copolymers of poly(n-stearyl methacrylate), poly(n-lauryl methacrylate) and so on as a low-molecular-weight crystalline polymer (e.g. copolymer of n-stearyl acrylate and ethyl methacrylate, and so on). However, it is not limited thereto.

In particular, the releasing agent a is preferably a wax having a melting point of 50° C. to 120° C. Such a wax acts effectively as a releasing agent a fixing roller and a toner boundary, and thus it is possible to improve high-temperature offset resistance may be improved without coating a releasing agent such as oil on the fixing roller. The melting point of the wax may be obtained by measuring a maximum endothermic peak using TG-DSC system TAS-100 (manufactured by Rigaku Corporation) as a differential scanning calorimeter.

The releasing agent a may be used alone or in combination of two or more. It is preferably included within toner particles for an ultra-high-speed printing system capable of supporting a print-on-demand (POD) field.

A content of the releasing agent a in the transparent toner is preferably in a range of 3% by mass to 12% by mass. When the content in the toner is less than 3% by mass, offset is likely to occur. When the content in the toner exceeds 12% by mass, spent carrier is likely to occur, and further image quality is likely to degrade.

Similarly, it is preferable that a content of the releasing agent b in the color toner is also in the above numerical range.

Because of the releasing agent a included within the toner particles, it is possible to achieve both hot-offset resistance and fixing strength during fixing. As a result, it is possible to obtain high strength of rubbing test. Thereby, low-temperature fixing property may be ensured even when it is used in a high-speed image forming apparatus.

Also, the releasing agent a has an average particle diameter as a long diameter of preferably 0.2 μm to 2.0 μm. The average particle diameter of less than 0.2 μm results in smaller releasing effect. Also, when the average particle diameter exceeds 2.0 μm, granulation of the toner becomes difficult, and further it may result in spent toner. The average particle diameter of the releasing agent a is calculated by averaging long diameter values of the releasing agent a in 100 cross-sectional images obtained by TEM images.

<<Other Components>>

The other components in the transparent toner are not particularly restricted and may be appropriately selected according to purpose. Examples thereof include a charge controlling agent, an external additive, a cleanability improving agent and so on.

—Charge Controlling Agent—

The charge controlling agent is not particularly restricted, and all the heretofore known ones may be used. Examples thereof include nigrosine dyes, triphenylmethane dyes, chromium-containing metal complex dyes, molybdic acid chelate pigments, rhodamine dyes, alkoxy amines, quaternary ammonium salt (including fluorine-modified quaternary ammonium salts), alkyl amides, elemental phosphorus or phosphorus compounds, elemental tungsten or tungsten compounds, fluorine surfactants, metal salts of salicylic acid, metal salts of salicylic acid derivatives and so on.

Specific examples of the charge controlling agent include: BONTRON 03 of a nigrosine dye, BONTRON P-51 of a quaternary ammonium salt, BONTRON S-34 of a metal-containing azo dye, E-82 of oxynaphthoic acid metal complex, E-84 of salicylic acid metal complex and E-89 of phenol condensate (manufactured by Orient Chemical Industries Co., Ltd.); TP-302 and TP-415 of quaternary ammonium salt molybdenum complexes (manufactured by Hodogaya Chemical Co., Ltd.); Copy Charge PSY VP2038 of quaternary ammonium salt, Copy Blue PR of triphenylmethane derivative, Copy Charge NEG VP2036 and Copy Charge NX VP434 of quaternary ammonium salts (manufactured by Clariant (Japan) KK); LRA-901, and LR-147 of boron complex (manufactured by Carlit Japan Co., Ltd.); copper phthalocyanine, perylene, quinacridone, azo pigments, and other polymeric compounds having functional groups such as sulfonic acid group, carboxyl group, quaternary ammonium salt and so on. These may be used alone or in combination of two or more.

A content of the charge controlling agent is determined based on types of the binder resin, presence or absence of additives used according to necessity, and toner manufacturing methods including dispersion methods, and it is not unambiguously determined. Nonetheless, it is preferably 0.1 parts by mass to 10 parts by mass, and more preferably 0.2 parts by mass to 5 parts by mass with respect to 100 parts by mass of the binder resin. When the content exceeds 10 parts by mass, charging property of the toner is too large, reducing an effect of the main charge controlling agent and increasing an electrostatic attraction force with a developing roller, resulting in decreased fluidity of the developer and decreased image density. These charge controlling agents may be melt-kneaded with the masterbatch and the resin, and then dissolved and dispersed. They may of course be added directly to the organic solvent in dissolving and dispersing, or they may be fixed on a surface of the toner after the toner particles are manufactured.

—External Additive—

The transparent toner may include an external additive for assisting fluidity, developing property, and charging property.

Examples of the external additive include inorganic fine particles, polymeric fine particles and so on.

The inorganic fine particles have a primary particle diameter of preferably 5 nm to 2 μm, and more preferably 5 nm to 500 nm. Also, a specific surface area by a BET method is preferably 20 $m^2/g$ to 500 $m^2/g$. A content of the inorganic fine particles with respect to the transparent toner is preferably 0.01% by mass to 5% by mass, and more preferably 0.01% by mass to 2.0% by mass.

Specific examples of the inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride and so on.

Examples of the polymeric fine particles include: copolymers of polystyrene, methacrylic acid esters or acrylic acid esters obtained by soap-free emulsion polymerization, suspension polymerization or dispersion polymerization; polycondensation polymer particles of silicone, benzoguanamine or nylon; polymeric particles of thermosetting resins; and so on.

These external additives may be subjected to surface treatment for increased hydrophobicity, and thereby they may prevent degradation of fluidity properties and charge properties even under high humidity. Examples of preferable surface treating agents include a silane coupling agent, a silylating agent, silane coupling agent having a fluorinated alkyl group, an organic titanate coupling agent, aluminum coupling agent, silicone oil, modified silicone oil and so on.

—Cleanability Improving Agent—

Examples of the cleanability improving agent for removing a developer remaining after transfer on a photoconductor or a primary transfer medium include:

a metal salt of a fatty acid such as stearic acid, including zinc stearate and calcium stearate; and polymer particles obtained by soap-free emulsion polymerization of polymethyl methacrylate fine particles, polystyrene fine particles and so on. The polymer fine particles preferably have a relatively narrow particle size distribution, and the polymer fine particles have a volume-average particle diameter of preferably 0.01 μm to 1 μm.

[Properties of Transparent Toner]

A particle diameter and a particle size distribution of the transparent toner are not particularly restricted and may be appropriately selected according to purpose. Nonetheless, it is preferable that a volume-average particle diameter Dv is 3 μm to 7 μm, and a ratio of the volume-average particle diameter Dv to a number-average particle diameter Dn (Dv/Dn) is 1.2 or less. It is also preferable that a component having a particle diameter of 2 μm or less is 10% by number or less. The Dv of less than 3 μm causes cleaning failure and so on, resulting in poor image quality. The Dv exceeding 7 μm impairs uniformity of the transparent toner, resulting in an image with uneven gloss. Also, similarly, the ratio (Dv/Dn) exceeding 1.2 results in an image with uneven gloss.

The acid value of the toner is an important indicator of low-temperature fixing property and high temperature-resistant offset property, and it is derived from a terminal carboxyl group of the non-modified polyester resin. For controlling low-temperature fixing property (minimum fixing temperature, hot-offset occurrence temperature and so on), it is preferably 0.5 KOHmg/g to 40 KOHmg/g.

When the acid value exceeds 40 KOHmg/g, an elongation reaction and/or crosslinking reaction of a reactive modified polyester resin becomes insufficient. As a result, high temperature-resistant offset property may degrade. Also, when the acid value is less than 0.5 KOHmg/g, there are cases where an effect of improving dispersion stability by a base during manufacturing may not be obtained or cases where an elongation reaction and/or crosslinking reaction of the reactive modified polyester resin easily proceeds, resulting in reduced production stability.

<Color Toner>

The color toner includes at least the binder resin b, the releasing agent b and the colorant b, and it further includes other components according to necessity.

<<Binder Resin>>

The binder resin b includes at least the non-crystalline resin β and the crystalline resin β, and it further includes other binder resins according to necessity.

The non-crystalline resin β and the crystalline resin β included in the color toner are not particularly restricted and may be appropriately selected according to purpose. Those similar to the non-crystalline resin α and the crystalline resin α in the transparent toner may be used, respectively.

<<Releasing Agent>>

The releasing agent b included in the color toner is not particularly restricted and may be appropriately selected according to purpose. Those similar to the releasing agent a in the transparent toner may be used.

<<Colorant b>>

The colorant b is not particularly restricted, and it may be appropriately selected from heretofore known dyes and pigments according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG), Vulcan Fast Yellow (5G, R), tartrazine lake, quinoline yellow lake, Anthrazane Yellow BGL, isoindolinone yellow, colcothar, red lead, lead vermilion, cadmium red, cadmium mercury red, antimony vermilion, Permanent Red 4R, Para Red, fiser red, para-chloro-ortho-nitroaniline red, Lithol Fast Scarlet G, Brilliant Fast Scarlet, Brilliant Carmine BS, Permanent Red (F2R, F4R, FRL, FRLL, F4RH), Fast, Scarlet, VD, Vulcan Fast, Rubine B, Brilliant Scarlet G, Lithol Rubine GX, Permanent Red F5R, Brilliant Carmine GB, Pigment Scarlet 3B, Bordeaux 5B, Toluidine Maroon, Permanent Bordeaux F2K, Hello Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, lithopone and so on. These may be used alone or in combination of two or more.

A content of the colorant b with respect to the toner is usually 1% by mass to 15% by mass, and preferably 3% by mass to 10% by mass.

The colorant b may also be used as a masterbatch combined with a resin. A resin for masterbatch for manufacturing the masterbatch or kneaded with the masterbatch is not particularly restricted and may be appropriately selected according to purpose. Examples thereof include, other than the binder resin b: polymers of styrene and substitution products thereof such as polystyrene, poly-p-chlorostyrene, polyvinyltoluene and so on; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and so on; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, paraffin wax and so on. These may be used alone or in combination of two or more.

A method for manufacturing the masterbatch is not particularly restricted and may be appropriately selected according to purpose. Examples thereof include a method of mixing and/or kneading the resin for masterbatch and the colorant with an application of high shear force. At this time, to enhance an interaction between the colorant and the resin for masterbatch, an organic solvent may be used.

Also, a so-called flushing method is favorably used since a wet cake of the colorant may be used as it is, without necessity of drying. The flushing method is a method of mixing and/or kneading an aqueous paste of the colorant including water with the resin for masterbatch and an organic solvent to remove the water and the organic medium by transferring the colorant to the resin for masterbatch.

The method of mixing and/or kneading is not particularly restricted and may be appropriately selected according to purpose. Nonetheless, a method of using a high shear dispersing apparatus such as three-roll mill is preferable.

<<Other Components>>

Other components included in the color toner are not particularly restricted and may be appropriately selected according to purpose. Those similar to the other components in the transparent toner may be used.

[Production of Toner]

It is difficult to obtain a sharp particle size distribution with a conventional pulverized toner, and because of this, transparent toner on an image has had degraded uniformity. As a result, uneven gloss has occurred.

On the other hand, in manufacturing a color toner of the present invention, in an oil phase obtained by dissolving or dispersing a colorant, a releasing agent, a binder resin precursor including a modified polyester resin and other binder resin components (e.g. the crystalline polyester resin described hereinabove, a non-crystalline polyester resin described hereinafter, a non-modified polyester resin and so on) in an organic solvent, a compound which elongates or crosslinks with the binder resin precursor is dissolved. A charge controlling agent or an external additive may be mixed in the organic solvent. Thereafter, the oil phase is dispersed in an aqueous medium containing a fine-particle dispersant to obtain an emulsified dispersion. Then, the binder resin precursor is subjected to a crosslinking reaction and/or an elongation reaction in the emulsified dispersion, and the organic solvent is removed. According to the manufacturing method of the present invention, it is easy to control the particle size distribution of the toner. Here, to manufacture a transparent toner, the above process is carried out without mixing the colorant.

—Binder Resin Included in Oil Phase—

In the present invention, as the binder resin components included in the oil phase, the crystalline polyester resin, the non-crystalline polyester resin, the binder resin precursor, the modified polyester resin and the non-modified polyester resin may be used in combination, and binder resin components other than these resins may further be included. As the binder resin components, it is preferable to include a polyester resin, and it is further preferable to include the polyester resin in the binder resin by 50% by mass or greater. A content of the polyester resin of less than 50% by mass may result in degraded low-temperature fixing property. It is particularly preferable that all the resins in the binder resin components are a polyester resin.

Here, examples of the binder resin components other than a polyester resin include: polymers of styrene or substituted styrene such as polystyrene, poly(p-chlorostyrene), polyvinyltoluene and so on; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and so on; polymethyl methacrylate, polybutyl methacrylate, polyvinyl chloride, polyvinyl acetate, polyethylene, polypropylene, epoxy resin, epoxy polyol resin, polyurethane resin, poly amide resin, polyvinyl butyral, polyacrylic acid, rosin, modified rosin, terpene resin, aliphatic or alicyclic hydrocarbon resin, aromatic petroleum resin, chlorinated paraffin, paraffin wax and so on.

—Compound which Elongates or Crosslinks with Binder Resin Precursor—

As the compound which elongates or crosslinks with the binder resin precursor, a compound having an active hydrogen group is exemplified. Typical examples thereof include amines. Examples of the amines include diamine compounds, polyamine compounds having three or more hydroxyl groups, amino alcohol compounds, aminomercaptan compounds, amino acid compounds, and compounds with these amino groups blocked. Examples of the diamine compounds include aromatic diamines (phenylenediamine, diethyltoluene diamine, 4,4'-diaminodiphenylmethane and so on); alicyclic diamines (4,4'-diamino-3,3'-dimethyldicyclohexylmethane, diamine cyclohexane, isophorone diamine and so on); and aliphatic diamines (ethylenediamine, tetramethylenediamine, hexamethylenediamine and so on) and so on. Examples of the polyamine compounds having three or more hydroxyl groups include diethylene triamine, triethylene tetramine and so on. Examples of the amino alcohol compounds include ethanolamine, hydroxyethyl aniline and so on. Examples of the aminomercaptan compounds include aminoethyl mercaptan, aminopropyl mercaptan and so on.

Examples of the amino acid compounds include aminopropionic acid, aminocaproic acid and so on. Examples of the compounds with these amino groups blocked include ketimine compounds, oxazoline compounds and so on obtained by the amines and ketones (acetone, methyl ethyl ketone, methyl isobutyl ketone and so on). Among these amines, those preferable are the diamine compound and a mixture of the diamine compound and a small amount of the polyamine compounds.

—Aqueous Medium—

An aqueous medium used in the present invention may be water alone, but a water-miscible solvent may be used in combination. Examples of the water-miscible solvent include alcohols (methanol, isopropanol, ethylene glycol and so on), dimethylformamide, tetrahydrofuran, cellosolves (methyl cellosolve and so on), lower ketones (acetone, methyl ethyl ketone and so on) and so on.

The binder resin precursor, the colorant, the releasing agent, the crystalline polyester dispersion, the charge controlling agent, the non-modified polyester resin and so on which constitute the toner particles may be mixed in the aqueous medium in forming a dispersion, but it is more preferable to mix these toner materials beforehand followed by dispersing the mixture in the aqueous medium. Also, in the present invention, the other toner materials such as colorant, releasing agent, charge controlling agent and so on are not necessarily mixed in the aqueous medium in forming particles; they may be added after the particles are formed. For example, particles without a colorant are formed first, and then a colorant may be added by a heretofore known dyeing method.

A dispersing method is not particularly restricted, and a heretofore known equipment such as low-speed shearing equipment, high-speed shearing equipment, friction equipment, high-pressure jet equipment and ultrasonic waves may be used. To obtain the dispersion with an average particle diameter of 2 μm to 20 μm, the high-speed sharing dispersion equipment is preferable. When the high-speed shearing disperser is used, rotational speed is not particularly restricted. It is usually 1,000 rpm to 30,000 rpm, and preferably 5,000 rpm to 20,000 rpm. A dispersion time is not particularly restricted, and for a batch system, it is usually 0.1 minutes to 60 minutes. A temperature during dispersion is usually 0° C. to 80° C. (under pressurization), and preferably 10° C. to 40° C.

An amount of the aqueous medium used with respect to 100 parts by mass of the toner composition is usually 100 parts by mass to 1,000 parts by mass. When it is less than 100 parts by mass, toner particles having a predetermined particle diameter cannot be obtained due to poor dispersion condition of the toner composition. The amount exceeding 1,000 parts by mass is not economical. Also, a dispersant may be used according to necessity. Using the dispersant is preferable since it enables a sharp particle size distribution as well as stable dispersion.

As a method to react the polyester prepolymer and the compound having an active hydrogen group, the compound having an active hydrogen group may be added and reacted in an aqueous medium before dispersing the toner composition, or the compound having an active hydrogen group is added after dispersing the toner composition in the aqueous medium to cause reaction from particle interfaces. In this case, modified polyester by the polyester prepolymer is produced preferentially on a surface of the toner being manufactured, and it is possible to dispose a concentration gradient within the particles.

Examples of a dispersant for emulsifying and dispersing the oil phase with dispersed toner composition in a liquid including water include: anionic surfactants such as alkylbenzene sulfonate, α-olefin sulfonate, phosphoric acid ester and so on; cationic surfactants of an amine salt type such as alkylamine salt, amino alcohol fatty acid derivative, polyamine fatty acid derivative, imidazoline and so on, cationic surfactants of a quaternary ammonium salt type such as alkyltrimethyl ammonium salt, dialkyldimethyl ammonium salt and alkyldimethylbenzyl ammonium salt, and cationic surfactants such as pyridinium salt, alkyl iso-quinolinium salt, benzethonium chloride and so on; non-ionic surfactants such as fatty acid amide derivative and polyhydric alcohol derivative; and amphoteric surfactants such as alanine, dodecyldi(aminoethyl)glycine, di(octyl aminoethyl)glycine, N-alkyl-N,N-dimethyl ammonium betaine and so on.

Also, use of a surfactant having a fluoroalkyl group even in a very small amount can increase an effect thereof. Favorable examples of anionic surfactants having a fluoroalkyl group include: fluoroalkylcarboxylic acid having 2 to 10 carbon atoms and metal salts thereof, disodium perfluorooctane sulfonylglutamate, sodium 3-[ω-fluoroalkyl (C6 to C11)oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acid and a metal salt thereof, perfluoroalkylcarboxylic acid (C7 to C13) and metal salts thereof, perfluoroalkylcarboxylic acid (C7 to C13) and metal salts thereof, perfluoroalkyl (C4 to C12) sulfonic acid and metal salts thereof, perfluorooctanesulfonic acid diethanolamide, N-propyl-N-(2-hydroxyethyl)perfluorooctanesulfonamide, perfluoroalkyl (C6 to C10) sulfonamidepropyltrimethylammonium salt, perfluoroalkyl (C6 to C10)-N-ethylsulfonylglycine salt, monoperfluoroalkyl (C6 to C16) ethylphosphoric acid ester and so on.

As product names, SURFLON S-111, S-112, S-113 (manufactured by Asahi Glass Co., Ltd.), FLUORAD FC-93, FC-95, FC-98, FC-129 (manufactured by Sumitomo 3M Ltd.), UNIDYNE DS-101, DS-102 (manufactured by Daikin Industries, Ltd.), MEGAFACE F-110, F-120, F-113, F-191, F-812, F-833 (manufactured by DIC Corporation), EFTOP EF-102, 103, 104, 105, 112, 123A, 123B, 306A, 501, 201, 204 (manufactured by Tochem Products Inc.), FTERGENT F-100, F150 (manufactured by Neos Company Ltd.) and so on are exemplified.

Also, examples of cationic surfactants include: aliphatic quaternary ammonium salts such as aliphatic primary, secondary or tertiary amine acid having a fluoroalkyl group and perfluoroalkyl (C6 to C10) sulfonamidepropyl trimethyl ammonium salt, benzalkonium salts, benzethonium chloride, pyridinium salts, imidazolinium salts, and as commercial products, SURFLON S-121 (manufactured by Asahi Glass Co., Ltd.), FLUORAD FC-135 (manufactured by Sumitomo 3M Ltd.), UNIDYNE DS-202 (manufactured by Daikin Industries, Ltd.), MEGAFACE F-150, F-824 (manufactured by DIC Corporation), EFTOP EF-132 (manufactured by Tochem Products Inc.), FTERGENT F-300 (manufactured by Neos Company Ltd.) and so on.

Also, as an inorganic compound dispersant which is poorly soluble in water, tricalcium phosphate, calcium carbonate, titanium oxide, colloidal silica, hydroxyapatite and so on may also be used.

Also, dispersed droplets may be stabilized by a polymeric protective colloid or water-insoluble organic fine particles. Examples thereof include: acids such as acrylic acid, methacrylic acid, α-cyanoacrylic acid, α-cyanomethacrylic acid, itaconic acid, crotonic acid, fumaric acid, maleic acid, maleic anhydride and so on or (meth)acrylic monomer including a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide and so on; vinyl alcohols or ethers with vinyl alcohol such as vinyl methyl ether, vinyl ethyl ether, vinyl propyl ether; esters of vinyl alcohol and a compound having a carboxyl group such as vinyl acetate, vinyl propionate, vinyl butyrate and so on; acrylamide, methacrylamide, diacetone acrylamide and methylol compounds thereof; acid chlorides such as acrylic acid chloride, methacrylic acid chloride and so on; homopolymers or copolymers of those having a nitrogen atom or a heterocyclic ring thereof such as vinyl pyridine, vinyl pyrrolidone, vinyl imidazole and ethylene imine; polyoxyethylenes such as polyoxyethylene, polyoxypropylene, polyoxyethylene alkyl amine, polyoxypropylene alkyl amine, polyoxyethylene alkyl amides, polyoxypropylene alkyl amides, polyoxyethylene nonylphenyl ether, polyoxyethylene laurylphenyl ether, polyoxyethylene stearylphynyl ester, polyoxyethylene nonylphenyl ester and so on; celluloses such as methyl cellulose, hydroxyethyl cellulose, hydroxypropyl cellulose and so on.

Here, when an acid- or alkali-soluble compound such as calcium phosphate is used as the dispersion stabilizer, calcium phosphate may be removed from the fine particles by dissolving calcium phosphate by an acid such as hydrochloric acid and then by rinsing the particles with water. It may also be removed by other operations such as enzymatic decomposition.

In a case where the dispersant is used, the dispersant may be left remaining on a surface of the toner particles, but it is preferably removed by washing after reaction in view of charging of the toner.

Further, in order to reduce viscosity of the toner composition, a solvent in which polyester modified by reacting with the polyester prepolymer may be used. Use of the solvent is more preferable in view of sharp particle size distribution. The solvent preferably has volatility with a boiling point of less than 100° C. for easier removal. Examples of the solvent include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, methyl isobutyl ketone and so on. These may be used alone or in combination of two or more.

Especially, aromatic solvents such as toluene, xylene and so on and halogenated hydrocarbons such as methylene chloride, 1,2-dichloroethane, chloroform, carbon tetrachloride and so on are preferable. A used amount of the solvent with respect to 100 parts of the polyester prepolymer is usually 0 parts to 300 parts, preferably 0 parts to 100 parts, and further preferably 25 parts to 70 parts. When the solvent is used, it is removed by heating under a normal pressure or a reduced pressure after elongation and/or crosslinking reaction.

A reaction time for elongation and/or crosslinking reaction is selected according to reactivity based on a combination of the polyester prepolymer and the compound having an active hydrogen group. Nonetheless, it is usually 10 minutes to 40 hours, and preferably 30 minutes to 24 hours. A reaction temperature is usually 0° C. to 100° C., and preferably 10° C. to 50° C. Also, a heretofore known catalyst may be used according to necessity. Specific examples thereof include tertiary amines such as triethylamine and imidazole.

In order to remove the organic solvent from the obtained emulsified dispersion, a method to heat the whole system gradually to remove the organic solvent in the liquid droplets completely by evaporation may be used. Alternatively, the water-insoluble organic solvent in the liquid droplets is completely removed by spraying the emulsified dispersion in a dry atmosphere; thereby, toner fine particles are formed while removing the aqueous dispersant by evaporation. As the dry atmosphere in which the emulsified dispersion is sprayed, a gas of heated air, nitrogen, carbon dioxide, combustion gas, and especially various gas flows heated to a temperature above the boiling point of the solvent having the highest boiling point are generally used. A desired quality may be obtained sufficiently in a processing of short time with a spray dryer, a belt dryer, rotary kiln and so on.

There are cases where a wide particle size distribution during emulsification and dispersion is maintained and washing and drying steps are carried out with the particle size distribution. In this case, the particle size distribution may be adjusted by classification to a desired particle size distribution.

By the classification operation, fine-particle portions may be removed in a liquid by a cyclone, a decanter, a centrifugation and so on. It is of course possible to carry out the classification operation after obtaining powder after drying, it is more preferable to do so in a liquid in view of efficiency. The resulting fine particles or coarse particles not needed may be returned to a kneading step and used for particle formation again. In that case, the fine particles or the coarse particles may be wet.

It is preferable that the dispersant used is removed from the obtained dispersion as much as possible, and it id preferably done at the same time as the classification operation described hereinabove.

Heterogeneous particles such as releasing-agent fine particles, charge-controlling fine particles, fluidizing fine particles, colorant fine particles and so on may be mixed with the obtained toner powder after drying, or a mechanical impact is applied to the mixed powder. Thereby, the heterogeneous particles are fixed or foxed on a surface of the toner particles, and it is possible to prevent the heterogeneous particles from departing the obtained composite particles.

Specifically, there are methods to apply an impact force to a mixture using blades rotating at high speed, a method to put the mixture in a high-speed airflow, which is accelerated to have the particles collide with one another or against a suitable collision plate and so on. Examples of apparatuses include ANGMILL (manufactured by Hosokawa Micron Co., Ltd.), a remodeled apparatus of I-TYPE MILL (manufactured by Nippon Pneumatic Mfg. Co.) with a reduced grinding air pressure, HYBRIDIZATION SYSTEM (manufactured by Nara Kikai Seisakusho Co., Ltd.), KRYPTRON SYSTEM (manufactured by Kawasaki Heavy Industries, Ltd.), an automatic mortar and so on.

—Heat-Dissolution/Cooling of Crystalline Polyester Resin—

The crystalline polyester resin is dissolved in the organic solvent by bringing it to a high temperature, and it is recrystallized by cooling. At this time, the crystalline polyester resin alone is heat-dissolved and cooled. If a non-crystalline polyester resin is mixed in this step, the crystalline polyester and the non-crystalline polyester dissolves during heat-dissolution, and sharp-melt property of the crystalline polyester in the toner is wasted. Therefore, it is necessary that the heat dissolution/cooling step is carried out with the crystalline polyester alone in the organic solvent.

A dispersion particle diameter of the crystalline polyester resin precipitated in the course of cooling is determined by a solution concentration or a cooling speed. After the solution with dispersed crystalline polyester is cooled, the non-crystalline polyester resin is dissolved in this solution, which is atomized in a mechanical-milling apparatus to prepare a crystalline polyester dispersion. When the crystalline polyester resin is dispersed alone in the organic solvent, solution viscosity increases as the dispersion particle diameter is reduced, and it becomes difficult to control it within an ideal range of 0.1 μm to 2.0 μm. A measure to reduce the solution concentration to reduce solution viscosity is not realistic in the process. Here, commercial milling apparatuses may be exemplified for a mechanical-milling apparatus (not shown) used in a step for atomizing the crystalline polyester resin precipitated in the course of cooling, and examples thereof include a bead-mill apparatus, a ball-mill apparatus, a wet-milling apparatus (ULTIMIZER apparatus, manufactured by is Sugino Machine Limited) and so on.

Thus, in the present invention, after cooling the solution with the crystalline polyester dispersed, this solution is dissolved in non-crystalline polyester, which is subjected to mechanical milling under controlled solution viscosity.

Also, it is necessary that a slurry temperature during mechanical milling is less than (T2−cs1), where (T2−cs1) is the endothermic shoulder temperature 1 calculated from the DSC second temperature increase of the crystalline polyester. When the slurry temperature is (T2−cs1) or greater, the crystalline polyester partially melts or is dissolved with the non-crystalline polyester, decreasing the toner Tg. As a result, the toner has degraded heat-resistant storage stability.

Also, when a dispersion particle diameter of the crystalline polyester resin (an average of the toner long diameter by cross-sectional observation) exceeds 2.0 μm, granulation of the toner becomes difficult, and the particle size distribution tends to be broad. Thus, it is necessary that the dispersion diameter of the crystalline polyester resin is 2.0 μm or less.

As the solution concentration, the crystalline polyester resin is preferably 1% by mass to 20% by mass in the organic solvent during high-temperature dissolution/cooling. Also, it is desirable to mix the non-crystalline polyester during mechanical milling so that a ratio of the crystalline polyester resin/non-crystalline polyester resin is 10/90 to 90/10.

As the organic solvent used in the step for dispersing the crystalline polyester, those used form a homogeneous solution by complete dissolution of the crystalline polyester resin at a high temperature and which form, on the other hand, a heterogeneous opaque solution by phase separation from the crystalline polyester resin upon cooling. Specifically, with a melting temperature of the crystalline polyester resin (Tm) as a basis, the solvent demonstrates a non-solvent property at a temperature of less than (Tm−40)° C. and a favorable solvent property at a temperature or greater. As specific examples, toluene, ethyl acetate, butyl acetate, methyl ethyl ketone, methyl isobutyl ketone and so on may be used alone or in combination of two or more.

(Developer Set)

A developer set of the present invention includes at least the toner set of the present invention. The developer set includes: a developer including at least the transparent toner; and one or more developers, each including at least the color toner.

The developers described above respectively include further other components such as carrier according to necessity.

The developer is not particularly restricted as long as it includes the toner of the present invention. It may be a one-component developer composed only of the toner, i.e. a magnetic toner or a non-magnetic toner, or it may be a two-component developer composed of the toner and a carrier. It is preferably the two-component developer.

When the toner is used in the two-component developer, it is used by mixing with a magnetic carrier, and a content ratio of the carrier and the toner in the developer is preferably 1 part by mass to 10 parts by mass of the toner with respect to 100 parts by mass of the carrier. As the magnetic carrier, conventionally heretofore known ones such as iron powder, ferrite powder, magnetite powder, magnetic resin carrier and so on having an average particle diameter of about 20 μm to 200 μm may be used.

The carrier is preferably coated with a coating material. Examples of the coating material include: amino resins (e.g. urea-formaldehyde resin, melamine resin, benzoguanamine resin, urea resin, polyamide resin and so on); polyvinyl and polyvinylidene resins (e.g. acrylic resin, polymethyl methacrylate resin, polymethyl methacrylate resin, polyacrylonitrile resin, polyvinyl acetate resin, polyvinyl alcohol resin, polyvinyl butyral resin, polystyrene resin such as polystyrene resin and styrene-acrylic copolymer resin and so on, halogenated olefin resin such as polyvinyl chloride and so on); polyester resins (e.g. polyethylene terephthalate resin, polybutylene terephthalate resin and so on); polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoro-terpolymers such as terpolymer of tetrafluoroethylene, vinylidene fluoride and non-fluorine monomer; silicone resins, epoxy resins and so on.

Also, the coating resin may include electrically conductive powders such as metal powder, carbon black, titanium oxide, tin oxide, zinc oxide and so on according to necessity. The electrically conductive powder has an average particle diameter of preferably 1 μm or less. When the average particle diameter exceeds 1 μm, electrical resistance may be difficult to control.

The toner used in the one-component developer or the two-component developer has a glass transition temperature of preferably 40° C. to 70° C. Thereby, low-temperature fixing property, heat-resistant storage stability and high durability may be achieved. When the glass transition temperature is less than 40° C., blocking in a developing machine or filming to a photoconductor may occur. When it exceeds 70° C., low-temperature fixing property may decrease.

(Image Forming Method)

An image forming method of the present invention includes at least a electrostatic latent image forming step, a developing step, a transfer step, and a fixing step, and it further includes other steps such as cleaning step, neutralizing step and so on according to necessity.

The electrostatic latent image forming step is a step for forming an electrostatic latent image on the photoconductor.

The developing step is a step for forming a visible image by developing the electrostatic latent image using the toner set of the present invention.

The transfer step is a step for transferring the visible image on a recording medium.

The fixing step is a step for fixing the visible image transferred on the recording medium.

The image forming method is an image forming method to form an image on a recording medium with one or more color toners and a transparent toner which does not include a colorant. Both the color toner and the transparent toner include crystalline polyester. The releasing agent in the transparent toner has an average particle diameter as a long diameter of 0.2 μm to 2.0 μm, and there is a relationship of $1<A/B<1.5$, where A is defined as an area of the releasing agent existing near an internal surface of the transparent toner, and B is defined as an area of the releasing agent existing near an internal surface of the color toner.

(Image Forming Apparatus)

An image forming apparatus of the present invention includes at least a photoconductor, an electrostatic latent image forming unit, a developing unit, a transfer unit, and a fixing unit, and it further includes other units such as cleaning unit, neutralizing unit and so on according to necessity.

The electrostatic latent image forming unit is a unit for forming an electrostatic latent image on the photoconductor.

The developing unit is a unit equipped with the toner set of the present invention, and it forms a visible image by developing the electrostatic latent image using the toner set.

The transfer unit is a unit for transferring the visible image to a recording medium.

The fixing unit is a unit for fixing the visible image transferred on the recording medium.

The electrostatic latent image forming step may be favorably carried out by the electrostatic latent image forming unit. The developing step may be favorably carried out by the developing unit. The transfer step may be favorably carried out by the transfer unit. The fixing step may be favorably carried out by the fixing unit.

Figure 2:
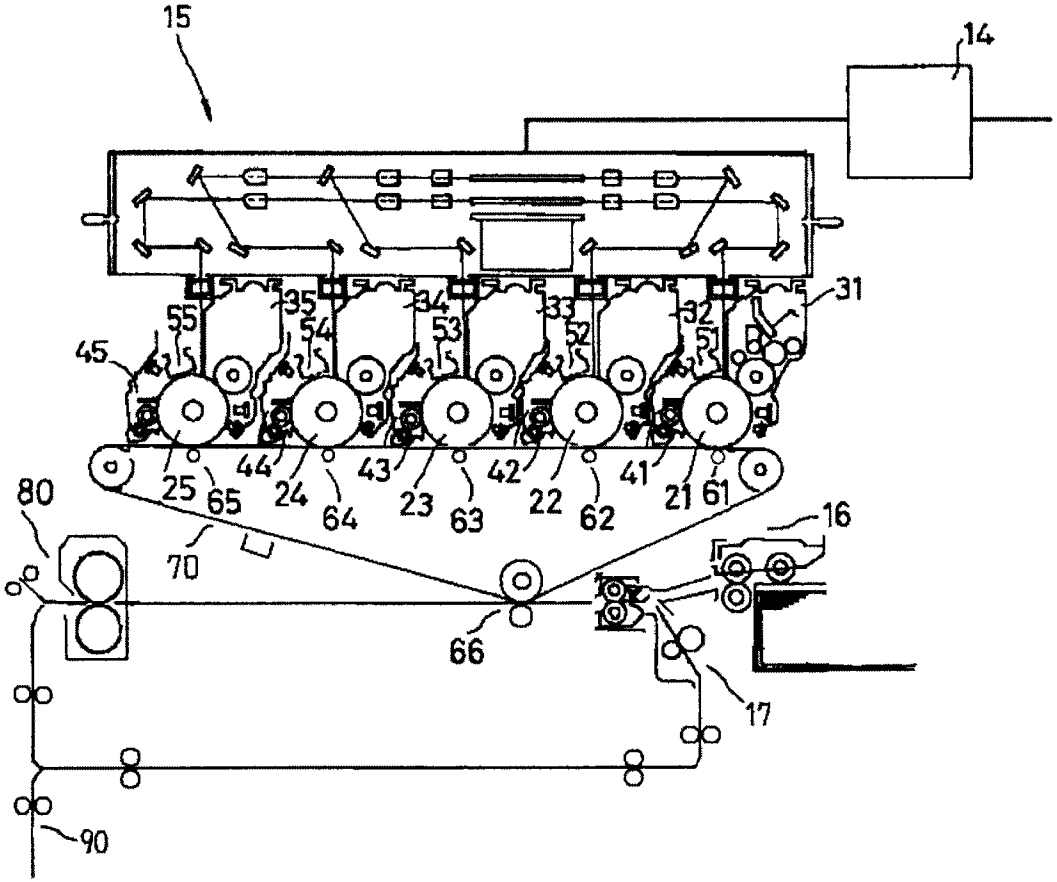
FIG. 2 is a diagram illustrating an overview of another example of an image forming apparatus.

FIG. 1 and FIG. 2 are diagrams illustrating an overview of an image forming apparatus.

Each image forming apparatus in FIG. 1 and FIG. 2 illustrates an ultra-high-speed printing system having a linear speed of 300 mm/second to 2,000 mm/second capable of supporting a print-on-demand (POD) field, and it is possible to obtain sufficient gloss even with one fixing. When higher gloss is desired, a portion to have high-gloss is subjected to latent image formation, exposure and development using the color toner and the transparent toner, and is then transferred to a recording medium and fixed by a fixing machine in a first image formation. Thereafter, a location where the color toner and the transparent toner are not fixed in the first image formation is subjected to latent image formation, exposure and development using the color toner, and is then transferred to the recording medium and fixed by the fixing machine. The portion where the transparent toner is formed has a larger toner amount than the portion where the transparent toner is not formed, but a sufficient amount of heat may be supplied by passing the fixing machine twice. This increases surface smoothness, resulting in high gloss. In view of productivity, fixing once is preferable.

Meanwhile, gloss of the color toner may be selected according to intended use. When the color toner has high gloss, gloss of the transparent toner tends to be high, but gloss difference on a recording medium is small.

Also, use of a color toner with low gloss is likely to increase gloss difference on a recording medium, and high gloss is less likely to be obtained even with an application of a transparent toner on top thereof. This is because, for the color toner with low gloss, there is a force acting so that the color toner resin itself returns to its original by viscoelasticity, resulting in a slightly uneven surface after fixing.

Here, the toner layer thickness may be measured by cutting the recording medium with a microtome and observing the toner layer thickness.

[Specific Example of Image Forming Method 1]

A first image forming method is explained in reference to FIG. 1.

Image data sent to an image processing unit (hereinafter referred to as "IPU") (14) prepare image signals of 5 colors, namely Y (yellow), M (magenta), C (cyan), Bk (black) and transparent color. Next, the Y, M, C, Bk and transparent image signals in the image processing unit are transmitted a writing unit (15).

The writing unit (15) modulates and scans 5 laser beams for Y, M, C, Bk and transparent color. After photoconductor drums are charged by charging units (51, 52, 53, 54, 55) as charging means, electrostatic latent image are sequentially formed on the photoconductor drums (21, 22, 23, 24, 25) for developing, respectively.

Here, for example, the first photoconductor drum (21) corresponds to Bk; the second photoconductor drum (22) corresponds to Y; the third photoconductor drum (23) corresponds to M; the fourth photoconductor drum (24) corresponds to C; and the fifth photoconductor drum (25) corresponds to the transparent color.

Next, by developing units (31, 32, 33, 34, 35) as a developing and adhering means, toner images of respective colors are formed on the photoconductor drums (21, 22, 23, 24, 25).

Also, transfer paper fed by a paper-feeding unit (16) is conveyed on a transfer belt (70), and toner images on the photoconductor drums (21, 22, 23, 24, 25) are sequentially transferred on the transfer paper by transfer charge units (61, 62, 63, 64, 65) as a transfer unit.

After completion of the transfer step, the transfer paper is conveyed to a fixing unit (80), and the transferred toner image is fixed on the transfer paper in the fixing unit (80).

After completion of the transfer step, toners remaining on the photoconductor drums (21, 22, 23, 24, 25) are removed by cleaning units (41, 42, 43, 44, 45) as a cleaning means. Here, a configuration indicated by reference numeral 90 is a recording medium inversion means and a configuration indicated by reference numeral 17 is conveyance rollers for conveying a recording medium to the recording medium inversion means.

[Specific Example of Image Forming Method 2]

Next, a second image forming method which partially produces high gloss is explained in reference to FIG. 2.

First, similarly to the first image forming method, image data sent to an image processing unit (hereinafter referred to as "IPU") (14) prepare image signals of 5 colors, namely Y (yellow), M (magenta), C (cyan), Bk (black) and transparent color.

Next, a first image formation is carried out in the image processing unit to form partially high-gloss portion. The image signals of Y, M, C, Bk, transparent color for the partially high-gloss portion are transmitted to a writing unit (15). The writing unit (15) modulates and scans 5 laser beams for Y, M, C, Bk and transparent color. After photoconductor drums are charged by charging units (51, 52, 53, 54, 55), electrostatic latent images are sequentially formed on the respective photoconductor drums (21, 22, 23, 24, 25). Here, for example, the first photoconductor drum (21) corresponds to Bk; the second photoconductor drum (22) corresponds to Y; the third photoconductor drum (23) corresponds to M; the fourth photoconductor drum (24) corresponds to C; and the fifth photoconductor drum (25) corresponds to the transparent color.

Next, by developing units (31, 32, 33, 34, 35) as a developing and adhering means, toner images of respective colors are formed on the photoconductor drums (21, 22, 23, 24, 25). Also, transfer paper fed by a paper-feeding unit (16) is conveyed on a transfer belt (70), and toner images on the photoconductor drums (21, 22, 23, 24, 25) are sequentially transferred on the transfer paper by transfer charging units (61, 62, 63, 64, 65).

After completion of the transfer step, the transfer paper is conveyed to a fixing unit (80), and the transferred toner image is fixed on the transfer paper in the fixing unit (80).

After completion of the transfer step, toners remaining on the photoconductor drums (21, 22, 23, 24, 25) are removed by cleaning units (41, 42, 43, 44, 45) as a cleaning means.

The transfer paper after fixing is conveyed for the second image formation to the conveyance rollers (17) for conveying it to the recording medium inversion means (90). In the second image formation, image signals of a part on which the first image formation is not carried out and which is usually glossy is transmitted to the writing unit (15) by image processing operations.

In this unit, images of Y, M, C, Bk other than transparent color is written on the respective photoconductor drums (21, 22, 23, 24), developed similarly to the first image formation, transferred and fixed again in the fixing unit.

Here, regarding the image formation of the transparent toner, depending on image processing operations, the transparent toner is adhered on a portion having a small concentration on printing paper, or by specifying a region to be adhered, the transparent toner may be adhered to the whole printing paper or only to an area determined as an image portion.

In the image forming apparatus of FIG. 2 and an image forming method using the same, similarly to FIG. 1, toner images formed on the photoconductor drums (21, 22, 23, 24, 25) are once transferred to a transfer drum. Then, the toner image is transferred by a secondary transfer unit (66) to the transfer paper, which is fixed by the fixing unit (80).

In the present invention, the first image forming method and the second image forming method may both be used. When the transparent toner is thickly placed, a transparent toner layer on the transfer drum has a large thickness, which makes the secondary transfer difficult, and a transfer drum may be used.

EXAMPLES (DSC Measurement)

Figure 3:
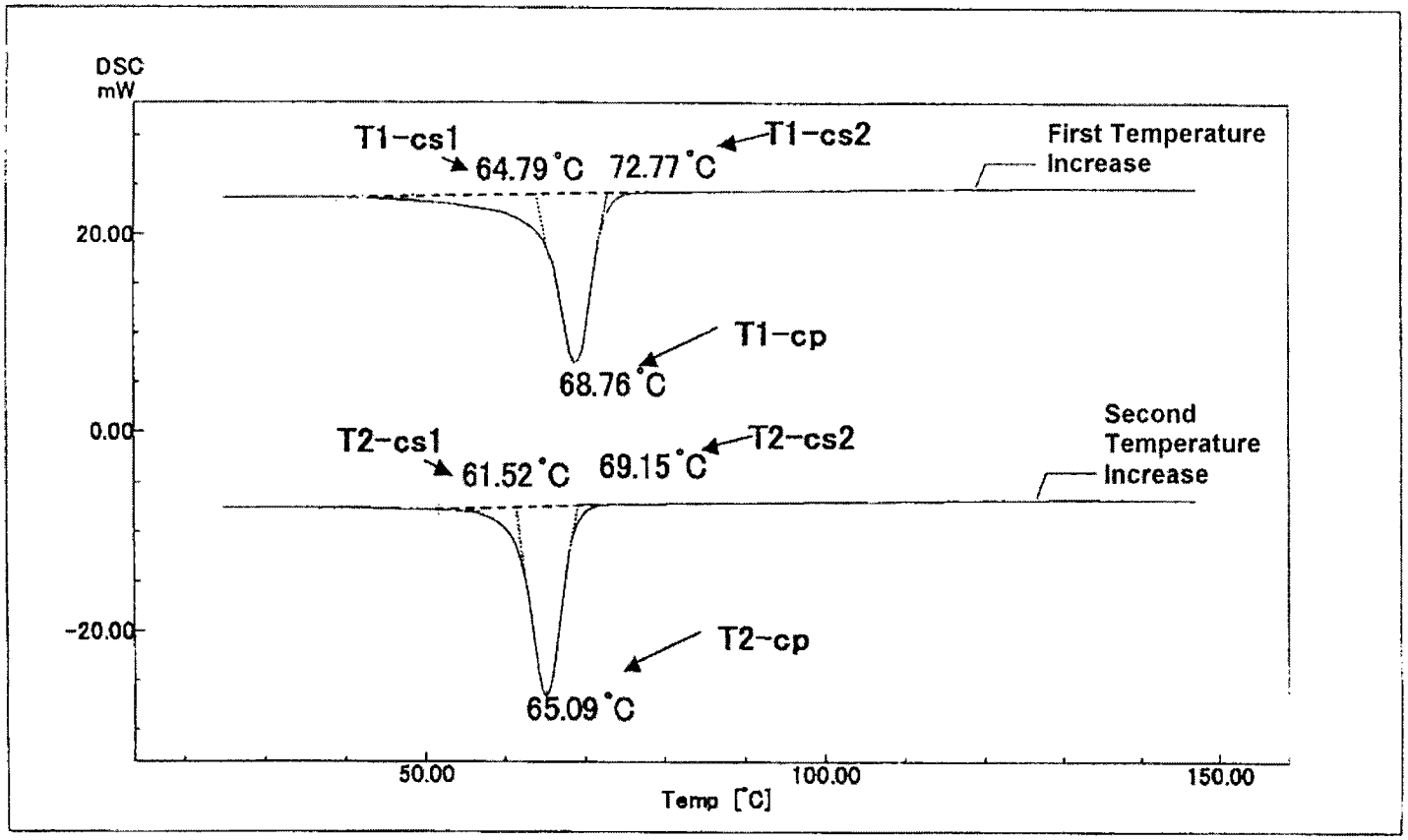
FIG. 3 is a diagram illustrating an example of a DSC measurement of crystalline polyester.

FIG. 3 is a diagram illustrating an example of DSC measurement of crystalline polyester.

In the present invention, an endothermic peak temperature and an endothermic shoulder temperature of crystalline polyester, non-crystalline polyester and a toner may be measured, for example, using a DSC system (differential scanning calorimeter) ("DSC-60", manufactured by Shimadzu Corporation). Specifically, an endothermic shoulder 1, an endothermic peak, and an endothermic shoulder 2 of a target sample may be measured according to the following procedure.

First, about 5.0 mg of polyester resin is placed in a sample container made of aluminum, and the sample container is mounted on a holder unit and set in an electric furnace. Next, under a nitrogen atmosphere, it is heated from 0° C. to 150° C. at a heating rate of 10° C./minute. Thereafter, it is cooled from 150° C. to 0° C. at a cooling rate of 10° C./minute and further heated to 150° C. at a heating rate of 10° C./minute, and a DSC curve is measured.

From the obtained DSC curves, using an analysis program in the DSC-60 system: a DSC curve of the first temperature increase is selected, and using "endothermic shoulder temperature" in analysis programs, the endothermic shoulder temperature 1 and the endothermic shoulder temperature 2 in the first temperature increase of the target sample may be obtained; a DSC curve of the second temperature increase is selected, and using "endothermic shoulder temperature", the endothermic shoulder temperature 1 and the endothermic shoulder temperature 2 in the second temperature increase of the target sample may be obtained. Here, the endothermic shoulder temperature is defined as a temperature at an intersection of a line in the background and a tapered line between the peak and the background.

The shoulder temperature is defined as endothermic shoulder 1, endothermic shoulder 2 and so on in order from low temperature. Also, from the obtained DSC curves, using the analysis program in the DSC-60 system: a DSC curve of the first temperature increase is selected using "endothermic peak temperature" in the analysis program, and the endothermic peak of the target sample in the first temperature increase may be obtained; a DSC curve in the second temperature increase is selected, and using "endothermic peak temperature" in the analysis program, the endothermic peak of the target sample in the second temperature increase may be obtained.

(Particle Size Distribution)

In the present invention, particle size distribution is measured using a Coulter Counter method.

Examples of a particle size distribution measurement apparatus include Coulter Counter TA-II and Coulter Multisizer II (both manufactured by Beckman Coulter).

In the present invention, particle size distribution is measured by connecting a PC-9801 personal computer (manufactured by NEC Corporation) to a Coulter Counter TA-II measurement apparatus via an interface for outputting a number distribution and volume distribution (manufactured by The Institute of Japanese Union of Scientists & Engineers).

Specifically, first, 0.1 mL to 5 mL of a surfactant (preferably, alkylbenzene sulfonate) is added as a dispersant to 100 mL to 150 mL of an electrolyte solution. Here, the electrolyte solution is an aqueous solution of about 1% by mass of first-class sodium chloride, and ISOTON-II (manufactured by Coulter) may be used, for example. Next, 2 mg to 20 mg of a sample was added and suspended, which was then dispersed by an ultrasonic disperser for 1 minute to 3 minutes. Using a 100-μm aperture, a volume and a number of particles of the toner are measured from the obtained dispersion, and a volume distribution and a number distribution are calculated.

As the channels, the following 13 channels were used: 2.00 μm or greater and less than 2.52 μm, 2.52 μm or greater and less than 3.17 μm, 3.17 μm or greater and less than 4.00 μm, 4.00 μm or greater and less than 5.04 μm, 5.04 μm or greater and less than 6.35 μm, 6.35 μm or greater and less than 8.00 μm, 8.00 μm or greater and less than 10.08 μm, 10.08 μm or greater and less than 12.70 μm, 12.70 μm or greater and less than 16.00 μm, 16.00 μm or greater and less than 20.20 μm, 20.20 μm or greater and less than 25.40 μm, 25.40 μm or greater and less than 32.00 μm and 32.00 μm or greater and less than 40.30 μm, and particles having a particle diameter of 2.00 μm or greater and less than 40.30 μm were targeted.

(Measurement of Acid Value)

In the present invention, an acid value is measured using a method according to JIS K0070-1992.

Specifically, first, 0.5 g (0.3 g as an ethyl acetate soluble content) of a sample is added to 120 mL of toluene and dissolved by stirring at 23° C. for about 10 hours. Next, 30 mL of ethanol is added, and this is regarded as a sample solvent. Here, when the sample does not dissolve, solvents such as dioxane, tetrahydrofuran and so on are used. Further, using an automatic potentiometric titrator DL-53 TITRATOR (manufactured by Mettler-Toledo International Inc.) and an electrode, DG113-SC (manufactured by Mettler-Toledo International Inc.), the acid value is measured at 23° C., and it is analyzed using an analysis software LA/BX Light Version 1.00.000.

Here, for calibration of the apparatus, a mixed solvent of 120 mL of toluene and 30 mL of ethanol is used. At this time, the measurement conditions are similar to those for the hydroxyl value described hereinafter.

The acid value may be measured as above.

Specifically, the acid value is calculated from an amount of a titrant required for titration with a 0.1-N potassium hydroxide/alcohol solution which has been standardized in advance using a formula: acid value [KOHmg/g]=amount of titrant

[mL]×N×56.1 [mg/ml]/sample mass [g] (here, N is a factor of the 0.1−N potassium hydroxide/alcohol solution).

(Measurement of Hydroxyl Value)

A hydroxyl value is measured using a method according to JIS K0070-1966.

Specifically, first, 0.5 g of a sample is accurately measured in a 100-mL measuring flask, to which 5 mL of an acetylating reagent is added. Next, it is heated in a warm bath at 100±5° C. for 1 hour to 2 hours, and then the flask is taken out from the warm bath and allowed to cool. Further, it is shaken with an addition of water to decompose acetic anhydride. Next, for complete decomposition of acetic anhydride, the flask is heated again in a warm bath for 10 minutes or greater and allowed to cool. Thereafter, a wall of the flask is washed well with an organic solvent.

Further, using an automatic potentiometric titrator DL-53 TITRATOR (manufactured by Mettler-Toledo International Inc.) and an electrode, DG113-SC (manufactured by Mettler-Toledo International Inc.), the hydroxyl value is measured at 23° C., and it is analyzed using an analysis software LA/BX Light Version 1.00.000. Here, for calibration of the apparatus, a mixed solvent of 120 mL of toluene and 30 mL of ethanol is used.

At this time, measurement conditions are as follows.

Stir
- Speed [%] 25
- Time [s] 15

EQP Titration
- Titrant/Sensor
- Titrant: $CH_3ONa$
- Concentration [mol/L]: 0.1
- Sensor: DG115
- Unit of measurement: mV
- Predispensing to Volume
- Volume [mL]: 1.0
- Wait time [s]: 0
- Titrant Addition: Dynamic
- dE(set) [mV]: 8.0
- dV(min) [mL]: 0.03
- dV(max) [mV]: 0.5
- Measure Mode: Equilibrium Controlled
- dE [mV]: 0.5
- dt [s]: 1.0
- t(min) [s]: 2.0
- t(max) [s]: 20.0
- Recognition
- Threshold: 100.0
- Steepest jump only: No
- Range: No
- Tendency: None
- Termination
- at maximum volume [mL]: 10.0
- at potential: No
- at slope: No
- after number EQPs: Yes
  - n=1
- comb. termination conditions: No
- Evaluation
- Procedure: Standard
- Potential1: No
- Potential2: No
- Stop for reevaluation: No Hereinafter, more specific examples are explained. The examples shall not be construed as limiting the scope of the present invention. Hereinafter, "part" and "%" denote "part by mass" and "% by mass", respectively. Also, the materials explained below may be prepared by using commercially available reagents.

(Synthesis of Crystalline Polyester Resin)

A 5-liter four-necked flask equipped with a nitrogen inlet tube, a dehydration tube, a stirrer and a thermocouple was charged with 2,010 parts of 1,4-butanediol, 2,520 parts of fumaric acid, 285 parts of trimellitic anhydride, and 4.9 parts of hydroquinone. It was reacted first at 160° C. for 6 hours, then heated to 200° C. and reacted fir 2 hours, and further reacted at 8.3 kPa for 1 hour. Thereby, [Crystalline Polyester Resin 1] was obtained. [Crystalline Polyester Resin 1] had an endothermic peak temperature (T2−cp) calculated from the DSC second temperature increase of 69° C., Mn of 1,100, Mw of 7,000, and Mw/Mn of 6.7. It had an endothermic shoulder temperature 1 (T2−cs1) of 60° C. and an endothermic shoulder temperature 2 (T2−cs2) of 78° C.

(Synthesis of Non-Crystalline Polyester (Low-Molecular Weight Polyester) Resin)

A reactor was charged with 240 parts of 2-mole ethylene oxide adduct of bisphenol A, 527 parts, terephthalic acid 210 parts of 3-mole propylene oxide adduct of bisphenol A, 46 parts of adipic acid and 2 parts of dibutyltin oxide. It was reacted first at a normal pressure and 230° C. for 8 hours and further reacted at a reduced pressure of 10 mmHg to 15 mmHg for 6 hours. Thereafter, the reactor was charged with 44 parts of trimellitic anhydride, and it was reacted at 180° C. and a normal pressure for 2 hours. Thereby, [Low-Molecular-Weight Polyester 1] corresponding to a non-crystalline polyester was obtained. [Low-Molecular-Weight Polyester 1] had a number-average molecular weight of 2,300, a weight-average molecular weight of 6,000, Tg of 47° C., and an acid value of 25 mgKOH/g.

(Synthesis of Polyester Prepolymer)

A reactor equipped with a cooling tube, a stirrer and a nitrogen inlet tube was charged with 682 parts of 2-mole ethylene oxide adduct of bisphenol A, 81 parts of 2-mole propylene oxide adduct of bisphenol A, 283 parts of terephthalic acid, 22 parts of trimellitic anhydride and 2 parts of dibutyltin oxide. It was reacted at a normal pressure and 230° C. for 8 hours and further reacted at a reduced pressure of 10 mmHg to 15 mmHg for 6 hours. Thereby, [Intermediate Polyester 1] was obtained. [Intermediate Polyester 1] had a number-average molecular weight of 2,100, a weight-average molecular weight of 9,000, Tg of 58° C., an acid value of 0.5 mgKOH/g, and a hydroxyl value of 51 mgKOH/g.

Next, a reactor equipped with a cooling tube, a stirrer and a nitrogen inlet tube was charged with 410 parts of [Intermediate Polyester 1], 89 parts of isophorone diisocyanate, and 500 parts of ethyl acetate. It was reacted at 100° C. for 5 hours, and [Prepolymer 1] as a polyester prepolymer was obtained. [Prepolymer 1] had a free isocyanate % of 1.53%.

(Synthesis of Ketimine)

A reactor equipped with a stirring rod and a thermometer was charged with 170 parts of isophorone diamine and 75 parts of methyl ethyl ketone. It was reacted at 50° C. for 5 hours, and [Ketimine Compound 1] was obtained. [Ketimine Compound 1] had an amine value of 418 mgKOH/g.

(Synthesis of Masterbatch (MB))

First, 1,200 parts of water, 540 parts of carbon black (Printex 35, manufactured by Evonik Degussa Japan Co., Ltd.) [DBP oil absorption=42 mL/100 mg; pH=9.5], and 1,200 parts of a polyester resin were added and mixed with a HENSCHEL mixer (manufactured by Nippon Coke & Engineering. Co., Ltd.). The mixture was kneaded using a two-roll mill at 150° C. for 30 minutes, rolled to cool and pulverized with a pulverizer, and [Masterbatch 1] was obtained.

(Preparation of Oil Phase of Color Toner 1)

A container equipped with a stirring rod and a thermometer was charged with 378 parts of [Low-Molecular-Weight Polyester 1], 105 parts of carnauba wax, 22 parts of charge controlling agent (CCA, salicylic acid metal complex E-84, manufactured by Orient Chemical Industries Co., Ltd.), and 940 parts of ethyl acetate. It is heated to 80° C. with stirring, maintained at 80° C. for 5 hours, and then cooled to 30° C. over 1 hour. Next, the container is charged with 500 parts [Masterbatch 1], and 500 parts of ethyl acetate, which was mixed for 1 hour, and [Raw Material Solution 1] was obtained. To a container, 1,320 parts of [Raw Material Solution 1] was transferred, and using a bead mill (ULTRA VISCO MILL, manufactured by Aimex Co., Ltd.) packed by 80% by volume with 0.5-mm zirconia beads, the carbon black and the wax were dispersed by running 5 passes under the conditions of a liquid feed rate 1 kg/hr and a peripheral speed of a disk of 6 m/second. Next, 1,042 parts of a 65-% ethyl acetate solution of [Low-Molecular-Weight polyester 1] was added, and by running 1 pass under the above conditions, [Color Oil Phase 1] was obtained.

(Preparation of Transparent Toner Oil Phase 1)

A container equipped with a stirring rod and a thermometer was charged with 378 parts of [Low-Molecular Weight Polyester 1], 105 parts of carnauba wax, 22 parts of CCA (salicylic acid metal complex E-84, manufactured by Orient Chemical Industries Co., Ltd.), and 1,200 parts of ethyl acetate. It was heated to 80° C. with stirring, maintained at 80° C. for 5 hours, and cooled to 30° C. over 1 hour, and [Transparent Raw Material Solution 1] was obtained.

Next, 1,320 parts of [Transparent Raw Material Solution 1] was transferred to a container, and using a bead mill (ULTRA VISCO MILL, manufactured by Aimex Co., Ltd.) packed by 80% by volume with 0.5-mm zirconia beads, the wax was dispersed by running 5 passes under the conditions of a liquid feed rate 1 kg/hr and a peripheral speed of a disk of 6 m/second. Next, 1,042 parts of a 65-% ethyl acetate solution of [Low-Molecular-Weight Polyester 1] was added, and by running 1 pass under the above conditions using the bead mill, [Transparent Oil Phase1] was obtained.

(Preparation of Transparent Toner Oil Phase 2)

A container equipped with a stirring rod and a thermometer was charged with 378 parts of [Low-Molecular-Weight Polyester 1], 105 parts of carnauba wax, 22 parts of CCA (salicylic acid metal complex E-84, manufactured by Orient Chemical Industries Co., Ltd.), and 1,200 parts of ethyl acetate. It was heated to 80° C. with stirring, maintained at 80° C. for 5 hours, and cooled to 30° C. over 1 hour, and [Transparent Raw Material Solution 2] was obtained.

Next, 1,320 parts of [Transparent Raw Material Solution 2] was transferred to a container, and using a bead mill (ULTRA VISCO MILL, manufactured by Aimex Co., Ltd.) packed by 80% by volume with 0.5-mm zirconia beads, the wax was dispersed by running 10 passes under the conditions of a liquid feed rate 1 kg/hr and a peripheral speed of a disk of 6 m/second. Next, 1,042 parts of a 65-% ethyl acetate solution of [Low-Molecular-Weight Polyester 1] was added, and by running 1 pass under the above conditions using the bead mill, [Transparent Oil Phase 2] was obtained.

(Preparation of Transparent Toner Oil Phase 3)

A container equipped with a stirring rod and a thermometer was charged with 378 parts of [Low-Molecular-Weight Polyester 1], 105 parts of carnauba wax, 22 parts of CCA (salicylic acid metal complex E-84, manufactured by Orient. Chemical Industries Co., Ltd.), and 1,200 parts of ethyl acetate. It was heated to 80° C. with stirring, maintained at 80° C. for 5 hours, and cooled to 30° C. over 1 hour, and [Transparent Raw Material Solution 3] was obtained.

Next, 1,320 parts of [Transparent Raw Material Solution 3] was transferred to a container, and using a bead mill (ULTRA VISCO MILL, manufactured by Aimex Co., Ltd.) packed by 80% by volume with 0.5-mm zirconia beads, the wax was dispersed by running 2 passes under the conditions of a liquid feed rate 1 kg/hr and a peripheral speed of a disk of 6 m/second. Next, 1,042 parts of a 65-% ethyl acetate solution of [Low-Molecular-Weight Polyester 1] was added, and by running 1 pass under the above conditions using the bead mill, [Transparent Oil Phase 3] was obtained.

(Preparation of Transparent Toner Oil Phase 4)

A container equipped with a stirring rod and a thermometer was charged with 378 parts of [Low-Molecular-Weight Polyester 1], 105 parts of carnauba wax, 22 parts of CCA (salicylic acid metal complex E-84, manufactured by Orient Chemical Industries Co., Ltd.), and 1,200 parts of ethyl acetate. It was heated to 80° C. with stirring, maintained at 80° C. for 5 hours, and cooled to 30° C. over 1 hour, and [Transparent Raw Material Solution 4] was obtained.

Next, 1,320 parts of [Transparent Raw Material Solution 4] was transferred to a container, and using a bead mill (ULTRA VISCO MILL, manufactured by Aimex Co., Ltd.) packed by 80% by volume with 0.5-mm zirconia beads, the wax was dispersed by running 3 passes under the conditions of a liquid feed rate 1 kg/hr and a peripheral speed of a disk of 6 m/second. Next, 1,042 parts of a 65-% ethyl acetate solution of [Low-Molecular-Weight Polyester 1] was added, and by running 1 pass under the above conditions using the bead mill, [Transparent Oil Phase 4] was obtained.

(Preparation of Transparent Toner Oil Phase 5)

A container equipped with a stirring rod and a thermometer was charged with 378 parts of [Low-Molecular-Weight Polyester 1], 105 parts of carnauba wax, 22 parts of CCA (salicylic acid metal complex E-84, manufactured by Orient Chemical Industries Co., Ltd.), and 1,200 parts of ethyl acetate. It was heated to 80° C. with stirring, maintained at 80° C. for 5 hours, and cooled to 30° C. over 1 hour, and [Transparent Raw Material Solution 5] was obtained.

Next, 1,320 parts of [Transparent Raw Material Solution 5] was transferred to a container, and using a bead mill (ULTRA VISCO MILL, manufactured by Aimex Co., Ltd.) packed by 80% by volume with 0.5-mm zirconia beads, the wax was dispersed by running 15 passes under the conditions of a liquid feed rate 1 kg/hr and a peripheral speed of a disk of 6 m/second. Next, 1,042 parts of a 65-% ethyl acetate solution of [Low-Molecular-Weight Polyester 1] was added, and by running 1 pass under the above conditions using the bead mill, [Transparent Oil Phase 5] was obtained.

(Preparation of Transparent Toner Oil Phase 6)

A container equipped with a stirring rod and a thermometer was charged with 378 parts of [Low-Molecular-Weight Polyester 1], 105 parts of carnauba wax, 22 parts of CCA (salicylic acid metal complex E-84, manufactured by Orient Chemical Industries Co., Ltd.), and 1,200 parts of ethyl acetate. It was heated to 80° C. with stirring, maintained at 80° C. for 5 hours, and cooled to 30° C. over 1 hour, and [Transparent Raw Material Solution 6] was obtained.

Next, 1,320 parts of [Transparent Raw Material Solution 6] was transferred to a container, and using a bead mill (ULTRA VISCO MILL, manufactured by Aimex Co., Ltd.) packed by 80% by volume with 0.5-mm zirconia beads, the wax was dispersed by running 1 pass under the conditions of a liquid feed rate 1 kg/hr and a peripheral speed of a disk of 6 m/second. Next, 1,042 parts of a 65-% ethyl acetate solution of

[Low-Molecular-Weight Polyester 1] was added, and by running 1 pass under the above conditions using the bead mill, [Transparent Oil Phase 6] was obtained.

(Preparation of Crystalline Polyester Dispersion 1)

First, 100 g of [Crystalline Polyester Resin 1] and 400 g of ethyl acetate were placed in a 2-L container made of metal and heated at 70° C. for dessolution. Then, it was cooled in an ice-water bath to 20° C. at a cooling rate of 20° C./minute. The cooled solution was observed, and it was confirmed that the crystalline polyester had recrystallized. In the dispersion after cooling, 100 g of Low-Molecular-Weight Polyester 1 was dissolved, and 500 mL of glass beads (3 mmϕ) was added, and then it was subjected to pulverization for 10 hours in a batch-type sand mill apparatus (manufactured by Kanpe Hapio Co., Ltd.). Thereby, [Crystalline Polyester Dispersion 1] having a volume-average particle diameter of 0.3 μm was obtained. A slurry temperature during pulverization was at a maximum of 30° C.

(Synthesis of Organic Fine Particles Emulsion)

A reactor equipped with a stirring rod and a thermometer was charged with 683 parts of water, 11 parts of sodium salt of sulfuric acid ester of ethylene oxide adduct of methacrylic acid (ELEMINOL RS-30, manufactured by Sanyo Chemical Industries, Ltd.), 138 parts of styrene, 138 parts of methacrylic acid, and 1 part of ammonium persulfate. It was stirred at 400 rpm for 15 minutes, and white emulsion was obtained. It was heated such that a temperature in the system reached to 75° C. and was reacted for 5 hours. Further, after adding 30 parts of a 1-% aqueous solution of ammonium persulfate, it was aged at 75° C. for 5 hours, and [Fine Particles Dispersion 1] as an aqueous dispersion of a vinyl resin (a copolymer of styrene-methacrylic acid-sodium salt of sulfuric acid ester of ethylene oxide adduct of methacrylic acid) was obtained. A volume-average particle diameter of [Fine Particles Dispersion 1] measured by LA-920 was 0.14 μm. A part of [Fine Particles Dispersion 1] was dried, and a resin component was isolated.

50% Aqueous Solution of Dodecyldiphenylether Sodium Disulfonate (Preparation of Aqueous Phase)

A milky liquid was obtained by mixing and stirring 990 parts of water, 83 parts of [Fine Particles Dispersion 1], 37 parts of a 48.5-% aqueous solution of dodecyl diphenyl ether sodium disulfonate (ELEMINOL MON-7, manufactured by Sanyo Chemical Industries, Ltd.), and 90 parts of ethyl acetate. This is referred to as [Aqueous Phase 1].

(Color Toner 1)

<Emulsification and Desolvation>

A container was charged with 664 parts of [Color Oil Phase 1], 109.4 parts of [Prepolymer 1], 73.9 parts of [Crystalline Polyester Dispersion 1], and 4.6 parts of [Ketimine Compound 1], which was mixed by TK HOMOMIXER (manufactured by Primix Corporation) at 5,000 rpm for 1 minute. Then, 1,200 parts of [Aqueous Phase 1] was added to the container and mixed by TK HOMOMIXER at a rotational speed of 11,000 rpm for 5 minutes, and [Emulsified Slurry 1] was obtained.

[Emulsified Slurry 1] was placed in a container equipped with a stirrer and a thermometer and was subjected to desolvation at 30° C. for 8 hours followed by aging at 45° C. for 4 hours, and [Color Dispersion Slurry 1] was obtained.

<Washing and Drying>

After vacuum filtration of 100 parts of [Color Dispersion Slurry 1], the following operations were carried out.

(1): To a filter cake, 100 parts of ion-exchanged water was added, which was mixed with TK HOMOMIXER (at a rotational speed of 12,000 rpm for 10 minutes), followed by filtration.

(2): To the filter cake of (1), 100 parts of a 10-% aqueous solution of sodium hydroxide was added, which was mixed with TK HOMOMIXER (at a rotational speed of 12,000 rpm for 30 minutes), followed by vacuum filtration.

(3): To the filter cake of (2), 100 parts of 10-% hydrochloric acid was added, which was mixed with TK HOMOMIXER (at a rotational speed of 12,000 rpm for 10 minutes), followed by filtration.

(4): To the filter cake of (3), 300 parts of ion-exchanged water was added, which was mixed with TK HOMOMIXER (at a rotational speed of 12,000 rpm for 10 minutes), followed by filtration. This operation was repeated twice, and [Filter Cake 1] was obtained.

Thereafter, [Filter Cake 1] was dried in a wind dryer at 45° C. for 48 hours and sieved with a mesh having openings of 75 μm, and [Color Toner 1] was obtained.

(Transparent Toner 1)

<Emulsification and Desolvation>

A container was charged with 664 parts of [Transparent Oil Phase 1], 120.2 parts of [Prepolymer 1], 73.9 parts of [Crystalline Polyester Dispersion 1], and 4.6 parts of [Ketimine Compound 1], which was mixed by TK HOMOMIXER (manufactured by Primix Corporation) at 5,000 rpm for 1 minute. Then, 1,200 parts of [Aqueous Phase 1] was added to the container and mixed by TK HOMOMIXER at a rotational speed of 11,000 rpm for 5 minutes, and [Emulsified Slurry 1] was obtained.

[Emulsified Slurry 1] was placed in a container equipped with a stirrer and a thermometer and was subjected to desolvation at 30° C. for 8 hours followed by aging at 45° C. for 4 hours, and [Transparent Dispersion Slurry 1] was obtained.

<Washing and Drying>

After vacuum filtration of 100 parts of [Transparent Dispersion Slurry 1] the following operations were carried out.

(1): To a filter cake, 100 parts of ion-exchanged water was added, which was mixed with TK HOMOMIXER (at a rotational speed of 12,000 rpm for 10 minutes), followed by filtration.

(2): To the filter cake of (1), 100 parts of a 10-% aqueous solution of sodium hydroxide was added, which was mixed with TK HOMOMIXER (at a rotational speed of 12,000 rpm for 30 minutes), followed by vacuum filtration.

(3): To the filter cake of (2), 100 parts of 10-% hydrochloric acid was added, which was mixed with TK HOMOMIXER (at a rotational speed of 12,000 rpm for 10 minutes), followed by filtration.

(4): To the filter cake of (3), 300 parts of ion-exchanged water was added, which was mixed with TK HOMOMIXER (at a rotational speed of 12,000 rpm for 10 minutes), followed by filtration. This operation was repeated twice, and [Filter Cake 1] was obtained.

Thereafter, [Filter Cake 1] was dried in a wind dryer at 45° C. for 48 hours and sieved with a mesh having openings of 75 μm, and [Transparent Toner 1] was obtained.

(Transparent Toner 2)

[Transparent Toner 2] was obtained in the same manner as the production of Transparent Toner 1 except that [Transparent Oil Phase 1] of Transparent Toner 1 was changed to [Transparent Oil Phase 2].

(Transparent Toner 3)

[Transparent Toner 3] was obtained in the same manner as the production of Transparent Toner 1 except that [Transparent Oil Phase 1] of Transparent Toner 1 was changed to [Transparent Oil Phase 3].

(Transparent Toner 4)

[Transparent Toner 4] was obtained in the same manner as the production of Transparent Toner 1 except that [Transparent Oil Phase 1] of Transparent Toner 1 was changed to [Transparent Oil Phase 4].

(Transparent Toner 5)

[Transparent Toner 5] was obtained in the same manner as the production of Transparent Toner 1 except that the mixing of Transparent Toner 1 at a rotational speed of 11,000 rpm for 5 minutes was changed to 13,000 rpm.

(Transparent Toner 6)

[Transparent Toner 6] was obtained in the same manner as the production of Transparent Toner 1 except that the mixing of Transparent Toner 1 at a rotational speed of 11,000 rpm for 5 minutes was changed to 8,000 rpm.

(Transparent Toner 7)

[Transparent Toner 7] was obtained in the same manner as the production of Transparent Toner 1 except that [Transparent Oil Phase 1] of Transparent Toner 1 was changed to [Transparent Oil Phase 5].

(Transparent Toner 8)

[Transparent Toner 8] was obtained in the same manner as the production of Transparent Toner 1 except that [Transparent Oil Phase 1] of Transparent Toner 1 was changed to [Transparent Oil Phase 6].

(Transparent Toner 9)

[Transparent Toner 9] was obtained in the same manner as Transparent Toner 1 except that [Crystalline Polyester Dispersion 1] in Transparent Toner 1 was not added.

In a henschel mixer, 100 parts of each toner obtained as above was mixed with 0.7 parts of hydrophobic silica and 0.3 parts of hydrophobic titanium oxide. Evaluation results of the obtained toners are shown in Table 1.

A developer composed of 5% of the toner treated with external additives silicone and 95% of copper-zinc ferrite carrier coated with a resin and having a volume-average particle diameter of 40 μm was prepared. Continuous printing was carried out using IMAGIO NEO 450, manufactured by Ricoh Company, Ltd., capable of printing 450,000 sheets of A4-size paper at a printing speed of 45 sheets/minute, and results were evaluated based on the following criteria. Evaluation results are shown in Table 1.

TABLE 1

| | Color toner | Transparent toner | | | | |
|---|---|---|---|---|---|---|
| | Type | Type | Vol.-avg. particle diameter Dv (μm) | Dv/Dn | Releasing agent a Long-axis avg. diam. (μm) | A/B |
| Example 1 | 1 | 1 | 6.1 | 1.14 | 0.5 | 1.2 |
| Example 2 | 1 | 2 | 5.0 | 1.13 | 0.2 | 1.2 |
| Example 3 | 1 | 3 | 6.3 | 1.20 | 1.8 | 1.4 |
| Example 4 | 1 | 4 | 5.4 | 1.15 | 1.0 | 1.1 |
| Comp. Ex. 1 | 1 | 5 | 4.8 | 1.14 | 0.5 | 0.9 |
| Comp. Ex. 2 | 1 | 6 | 5.8 | 1.25 | 0.5 | 1.6 |
| Comp. Ex. 3 | 1 | 7 | 4.7 | 1.13 | 0.15 | 1.3 |
| Comp. Ex. 4 | 1 | 8 | 6.5 | 1.24 | 2.5 | 1.2 |
| Comp. Ex. 5 | 1 | 9 | 5.4 | 1.17 | 0.5 | 1.2 |

TABLE 1-continued

| | Low-temp. fixing property | Hot-offset resistance | heat-resistant storage stability | Image graininess | Gloss (transparent portion) | Overall judgment |
|---|---|---|---|---|---|---|
| Example 1 | B | B | B | B | B | B |
| Example 2 | B | B | B | B | B | B |
| Example 3 | B | B | B | B | B | B |
| Example 4 | B | B | B | B | B | B |
| Comp. Ex. 1 | B | D | B | B | D | D |
| Comp. Ex. 2 | B | B | C | D | B | D |
| Comp. Ex. 3 | B | D | B | B | D | D |
| Comp. Ex. 4 | B | B | D | D | B | D |
| Comp. Ex. 5 | D | B | B | B | D | D |

(Combination of Color Toner and Transparent Toner)

Example 1

In Example 1 of Table 1, [Color Toner 1] and [Transparent Toner 1] were combined.

Example 2

In Example 2 of Table 1, [Color Toner 1] and [Transparent Toner 2] were combined.

Example 3

In Example 3 of Table 1, [Color Toner 1] and [Transparent Toner 3] were combined.

Example 4

In Example 4 of Table 1, [Color Toner 1] and [Transparent Toner 4] were combined.

Comparative Example 1

In Comparative Example 1 of Table 1, [Color Toner 1] and [Transparent Toner 5] were combined.

Comparative Example 2

In Comparative Example 2 of Table 1, [Color Toner 1] and [Transparent Toner 6] were combined.

Comparative Example 3

In Comparative Example 3 of Table 1, [Color Toner 1] and [Transparent Toner 7] were combined.

Comparative Example 4

In Comparative Example 4 of Table 1, [Color Toner 1] and [Transparent Toner 8] were combined.

Comparative Example 5

In Comparative Example 5 of Table 1, [Color Toner 1] and [Transparent Toner 9] were combined.

(Evaluation Items)

<Image Graininess (Sharpness)>

A photographic image was printed out in a single color using a digital full-color copier (IMAGIO COLOR 2800, manufactured by Ricoh Company, Ltd.), and degrees of graininess and sharpness were visually evaluated based on the following evaluation criteria.

—Evaluation Criteria—

A: Comparable to offset printing (excellent)

B: Slightly inferior to offset printing

C: Severely inferior to offset printing

D: Conventional electrophotographic image (poor)

<Particle Size>

A volume-average particle diameter and a number-average particle diameter of the toner were measured using a particle size measuring instrument "Coulter Counter TAII", manufactured by Coulter Electronics, Inc. with an aperture diameter of 100 μm.

<Heat-Resistant Storage Stability>

After it was stored at 50° C. for 8 hours, a toner was sieved with a 42-mesh sieve for 2 minutes, and a remaining ratio on the wire mesh. At this time, a toner having more favorable heat-resistant storage stability has a smaller remaining ratio.

Here, heat-resistant storage stability was evaluated based on the following evaluation criteria.

—Evaluation Criteria—

B: The remaining ratio was less than 20%.

C: The remaining ratio was 20% or greater and less than 30%.

D: The remaining ratio was 30% or greater.

<Gloss Evaluation>

With a combination of a transparent toner, a color toner, and an image forming method, an image was formed such that a solid image of the transparent toner with an added amount of 0.4 mg/cm$^2$ was superimposed on a solid image of the color toner with an added amount of 0.4 mg/cm$^2$. The image was fixed at a fixing temperature of 180° C. and a nip width of 20 mm, and glossiness of the image was measured.

As paper for this evaluation, POD Gross Coated Paper 128 g/m$^2$, manufactured by Oji Paper Co., Ltd., was used. The gloss was measured using GLOSS METER VGS-1D, manufactured by Nippon Denshoku Industries Co., Ltd., by evaluating the image at 10 locations with 60-degree gloss, and it was evaluated based on the following evaluation criteria.

—Evaluation Criteria—

B: Average gloss was 80 or greater.

C: Average gloss was 50 or greater and less than 80.

D: Average gloss was less than 50.

<Fixing Lower Limit (Low-Temperature Fixing Property)>

With a combination of a transparent toner, a color toner, and an image forming method, an image was formed such that a solid image of the transparent toner with an added amount of 0.4 mg/cm$^2$ was superimposed on a solid image of the color toner with an added amount of 0.4 mg/cm$^2$. The obtained sample image was evaluated every 10,000 sheets based on the following evaluation criteria.

—Evaluation Criteria—

B: There was no image peeling, and the image density remaining ratio after rubbing with a fixing pad was 85% or greater C: There was no image peeling, and the image density remaining ratio was 70% or greater and less than 85%.

D: There was image peeling, or the image density remaining ratio was less than 70%.

<Hot-Offset Resistance>

With a combination of a transparent toner, a color toner, and an image forming method, an image was formed such that a solid image of the transparent toner with an added amount of 0.4 mg/cm$^2$ was superimposed on a solid image of the color toner with an added amount of 0.4 mg/cm$^2$. With the nip width of 20 mm, the fixing set temperature was varied, and a hot-offset resistance temperature was measured.

—Evaluation Criteria—

B: 190° C. or greater

C: 170° C. or greater and less than 190° C.

D: less than 170° C.

<Overall Judgment>

Overall judgment was performed according to the following evaluation criteria.

—Evaluation Criteria—

B: "A" or "B" in all the evaluation items.

C: There was no "D" but were one or more "C" in all the evaluation items.

D: There were one or more "D" in the evaluation items.

From the results of Table 1, in Examples 1 to 4 having favorable overall judgment, the releasing agent (wax) had an average particle diameter as a long diameter of 0.2 μm to 2.0 μm. Also, there was a relationship of $1<A/B<1.5$, where A was defined as an area of the releasing agent existing on an internal surface in a cross-section of the transparent toner, and B was defined as an area of the releasing agent existing on an internal surface in a cross-section of the color toner. Also, the transparent toner had a diameter (Dv) of 3 μm to 7 μm. Further, a ratio of the volume-average particle diameter (Dv) to a number-average particle diameter (Dn) (Dv/Dn) was 1.2 or less. In this case, a toner having superior low-temperature fixing property, gloss and so on was obtained.

The embodiments are described as above, and embodiments illustrated in the diagrams shall not be construed as limiting the scope of the present invention. The embodiments may be modified within a range that occurs to those skilled in the art, such as other embodiments, addition, modification, deletion, etc. Any embodiment is included in the scope of the present invention as long as it achieves an effect of the present invention.

<1> A toner set, including:

a transparent toner which includes a binder resin a and a releasing agent a and which does not include a colorant; and one or more color toners, each of which includes a binder resin b, a colorant b and a releasing agent b, wherein the binder resin a includes a non-crystalline resin α and a crystalline resin α, wherein the binder resin b includes a non-crystalline resin β and a crystalline resin β, wherein the releasing agent a has an average particle diameter as a long diameter of 0.2 μm to 2.0 μm, and wherein the toner set has a relationship of $1<A/B<1.5$, where A is defined as an area of the releasing agent a in a cross-section of the transparent toner existing in a region from a surface of the transparent toner to a depth of ⅓ of a volume-average particle diameter of the transparent toner, and B is defined as an area of the releasing agent b in a cross-section of the color toner existing in a region from a surface of the color toner to a depth of ⅓ of a volume-average particle diameter of the color toner.

<2> The toner set according to <1>, wherein a content of the releasing agent a in the transparent toner is 3% by mass to 12% by mass.

<3> The toner set according to any one of <1> to <2>, wherein a content of the crystalline resin α in the transparent toner is 2% by mass to 30% by mass.

<4> The toner set according to any one of <1> to <3>, wherein the transparent toner has a volume-average particle diameter Dv of 3 μm to 7 μm, and a ratio of the volume-average particle diameter Dv to a number-average particle diameter Dn of the transparent toner (Dv/Dn) is 1.2 or less.

<5> The toner set according to any one of <1> to <4>, wherein both the crystalline resin α and the crystalline resin β have an endothermic peak temperature (T2−cp) calculated from the DSC second temperature increase of 60° C. or greater and less than 80° C., and the T2−cp satisfies the following relationship:

$$(T2-cs2)-10<(T2-cp)<(T2-cs1)+10$$

T2−cs1: an endothermic shoulder temperature 1 at a low-temperature side of the endothermic peak temperature calculated from the DSC second temperature increase; and T2−cs2: an endothermic shoulder temperature 2 at a high-temperature side of the endothermic peak temperature calculated from the DSC second temperature increase.

<6> The toner set according to any one of <1> to <5>, wherein both the transparent toner and the one or more color toners are toners obtained by dispersing in an aqueous medium an oil phase obtained by dissolving or dispersing toner materials in an organic solvent, to obtain an emulsified dispersion and by removing the organic solvent.

<7> The toner set according to any one of <1> to <6>, wherein the crystalline resin α exists in the non-crystalline resin α in a form of a domain, and the crystalline resin α has an average particle diameter as a long diameter of 0.1 μm to 2.0 μm.

<8> The toner set according to any one of <1> to <7>, wherein the crystalline resin α has a molecular weight distribution by a GPC of an ortho-dichlorobenzene soluble component as; a weight-average molecular weight (Mw) of 1,000 to 30,000; a number-average molecular weight (Mn) of 500 to 6,000; and Mw/Mn of 2 to 10.

<9> A developer set, including the toner set according to any one of <1> to <8>.

<10> An image forming method, including;

forming an electrostatic latent image, wherein an electrostatic latent image is formed on a photoconductor;

developing, wherein the electrostatic latent image is developed using the toner set according to any one of <1> to <8> to form a visible image;

transferring, wherein the visible image is transferred on a recording medium; and fixing, wherein the visible image transferred on the recording medium is fixed.

<11> An image forming apparatus, including;

a photoconductor;

an electrostatic latent image forming unit, configured to form an electrostatic latent image on the photoconductor;

a developing unit, including the toner set according to any one of <1> to <8>, and configured to develop the electrostatic latent image using the toner set to form a visible image;

a transfer unit, configured to transfer the visible image on a recording medium; and a fixing unit, configured to fix the visible image transferred on the recording medium.

This application claims priority to Japanese application No. 2012-057556, filed on Mar. 14, 2012 and incorporated herein by reference.

What is claimed is:

1. A toner set, comprising:

a transparent toner which comprises a binder resin a and a releasing agent a and which does not comprise a colorant; and one or more color toners, each of which comprises a binder resin b, a colorant b and a releasing agent b, wherein the binder resin a comprises a non-crystalline resin α and a crystalline resin α, wherein the binder resin b comprises a non-crystalline resin β and a crystalline resin β, wherein the releasing agent a has an average particle diameter as a long diameter of 0.2 μm to 2.0 μm, and wherein the toner set has a relationship of 1<A/B<1.5, where A is defined as an area of the releasing agent a in a cross-section of the transparent toner existing in a region from a surface of the transparent toner to a depth of ⅓ of a volume-average particle diameter of the transparent toner, and B is defined as an area of the releasing agent b in a cross-section of the color toner existing in a region from a surface of the color toner to a depth of ⅓ of a volume-average particle diameter of the color toner, and wherein the transparent toner has the volume-average particle diameter Dv of 3 μm to 7 μm, and a ratio of the volume-average particle diameter Dv to a number-average particle diameter Dn of the transparent toner (Dv/Dn) is 1.2 or less.

2. The toner set according to claim 1, wherein a content of the releasing agent a in the transparent toner is 3% by mass to 12% by mass.

3. The toner set according to claim 1, wherein a content of the crystalline resin α in the transparent toner is 2% by mass to 30% by mass.

4. The toner set according to claim 1, wherein both the crystalline resin α and the crystalline resin β have an endothermic peak temperature (T2−cp) calculated from the DSC second temperature increase of 60° C. or greater and less than 80° C., and the T2−cp satisfies the following relashionship:

$$(T2-cs2)-10<(T2-cp)<(T2-cs1)+10$$

T2−cs1: an endothermic shoulder temperature 1 at a low-temperature side of the endothermic peak temperature calculated from the DSC second temperature increase; and T2−cs2: an endothermic shoulder temperature 2 at a high-temperature side of the endothermic peak temperature calculated from the DSC second temperature increase.

5. The toner set according to claim 1, wherein both the transparent toner and the one or more color toners are toners obtained by dispersing in an aqueous medium an oil phase obtained by dissolving or dispersing toner materials in an organic solvent to obtain an emulsified dispersion and by removing the organic solvent.

6. The toner set according to claim 1, wherein the crystalline resin a exists in the non-crystalline resin α in a form of a domain, and the crystalline resin α has an average particle diameter as a long diameter of 0.1 μm to 2.0 μm.

7. The toner set according to claim 1, wherein the crystalline resin a has a molecular weight distribution by a GPC of an ortho-dichlorobenzene soluble component expressed as: a weight-average molecular weight (Mw) of 1,000 to 30,000; a number-average molecular weight (Mn) of 500 to 6,000; and Mw/Mn of 2 to 10.

* * * * *